US010407936B2

(12) United States Patent
Foltz

(10) Patent No.: US 10,407,936 B2
(45) Date of Patent: Sep. 10, 2019

(54) ADJUSTABLE SIGN POST BASE FOR REAL ESTATE SIGN

(71) Applicant: Sign Pros Inc., Redmond, WA (US)

(72) Inventor: Ken Foltz, Redmond, WA (US)

(73) Assignee: Sign Pros Inc., Redmond, WA (US)

( * ) Notice: Subject to any disclaimer, the term of this patent is extended or adjusted under 35 U.S.C. 154(b) by 0 days.

(21) Appl. No.: 15/977,445

(22) Filed: May 11, 2018

(65) Prior Publication Data

US 2018/0328069 A1 Nov. 15, 2018

Related U.S. Application Data

(60) Provisional application No. 62/505,033, filed on May 11, 2017.

(51) Int. Cl.

| | |
|---|---|
| ***G09F 7/18*** | (2006.01) |
| ***E04H 12/22*** | (2006.01) |
| ***G09F 15/00*** | (2006.01) |

(52) U.S. Cl.

CPC ..... *E04H 12/2269* (2013.01); *G09F 7/18* (2013.01); *G09F 15/0075* (2013.01); *G09F 2007/1804* (2013.01); *G09F 2007/1873* (2013.01)

(58) Field of Classification Search

CPC ..... G09F 2007/1856; E04H 12/2269; E04H 12/2238

USPC ..... 40/607.1, 607.11; 248/527, 535

See application file for complete search history.

(56) References Cited

U.S. PATENT DOCUMENTS

| | | | | |
|---|---|---|---|---|
| D174,421 | S * | 4/1955 | Ford | 248/527 |
| 2,849,202 | A * | 8/1958 | McCombs | E04H 12/2238 248/173 |
| 4,825,575 | A | 5/1989 | Rethke | |
| 4,878,303 | A * | 11/1989 | Banniza | G09F 7/20 40/606.14 |
| 6,299,124 | B1 * | 10/2001 | Reback | A47G 33/12 248/519 |
| 7,089,694 | B2 | 8/2006 | Allen | |
| 8,590,190 | B2 * | 11/2013 | White | E01F 9/692 40/591 |
| 2010/0043265 | A1 * | 2/2010 | Amrani | G09F 7/22 40/607.07 |
| 2013/0175422 | A1 * | 7/2013 | Clarke | E04H 12/2269 248/523 |
| 2015/0108318 | A1 * | 4/2015 | Orr | F16M 11/32 248/523 |

* cited by examiner

*Primary Examiner* — Joanne Silbermann

(74) *Attorney, Agent, or Firm* — Seed IP Law Group LLP

(57) ABSTRACT

A sign post support system can include a central column and a plurality of arms extending outward from the central column, the central column configured to support a bottom end of a sign post. A sign post support system can include a plurality of arms coupled to a bottom end of a sign post. A sign post support system can support a sign post without either the sign post or the support system extending below ground level.

9 Claims, 31 Drawing Sheets

ADJUSTABLE SIGN POST BASE FOR REAL ESTATE SIGN

BACKGROUND

Technical Field

The present disclosure is directed generally to real estate sign posts and in particular to systems for supporting real estate sign posts above a surface of the ground.

Description of the Related Art

"For Sale" signs are often posted publicly when residential, commercial, or other real estate is offered for sale, and many "For Sale" signs are hung from what have become relatively standard sign posts, which are sometimes referred to as "yardarms." These relatively standard sign posts often include a 5-7 foot tall vertical post made of 4×4 lumber, and a 3-4 foot long horizontal arm made of 4×4 lumber, which extends horizontally outward from a top portion of the vertical post. "For Sale" signs are often hung from the horizontal arm. The bottom end of the vertical post is typically buried in the ground so that it stands upright.

Many cities and municipalities are encouraging or requiring people to call a hotline before any drilling or excavating can occur. This includes digging holes for real estate sign posts. This requirement causes delay in installing new real estate signs, which otherwise could be a same-day service.

BRIEF SUMMARY

The present disclosure is directed to a real estate sign post system that supports a standard real estate sign with all components above a surface of the ground. This real estate sign post system allows the sign to be installed quickly, without drilling any holes in the ground. The system is adaptable to adjust to different surface features of the ground, such as a sloped yard or some other uneven surface, such as gravel.

The sign system includes a support system positioned on the ground with a sign post positioned within an opening in the support system. In particular, a bottom end of the sign post is, once installed in the support system, fully above the ground. In some variations, the bottom end of the sign post rests on a surface of the ground but is not in the ground. A bottom surface of the support system also rests on the ground.

In one variation, there are multiple arms that extend from a central member that has the opening to receive the sign post. The multiple arms extend radially from the central member. The opening in the central member is larger than dimensions of the sign post so that the sign post can be positioned within the central member in a vertical orientation no matter the contour of the ground on which the system is positioned.

In another variation, the support system includes a hollow vertical column configured to receive and hold a bottom end of the sign post; the hollow vertical column has a central open space having a cross-sectional shape including a square with rounded corners. In one version, the square may have a length between 3.5" and 5.5" or between 3.5" and 6.0", and a width between 3.5" and 5.5" or between 3.5" and 6.0". The hollow vertical column includes four plates coupled to fasteners, where each plate is aligned with an internal sidewall of the vertical column. Each plate is individually adjustable to provide support to the bottom end of the side post to support the sign post vertically despite a contour or angle of the ground. A plurality of arms is coupled to and extends outward from the hollow vertical column.

A method of installing a sign post may be summarized as comprising: positioning a support system on a ground surface such that no part of the support system is below the ground surface, the support system including a hollow central column; and positioning a lower end portion the sign post within the hollow central column such that no part of the sign post is below the ground surface, such that a bottom end of the sign post rests on the ground surface, and such that the sign post is supported by the support system.

The method may further comprise adjusting fasteners extending through the hollow central column until the sign post is secured to the support system by the fasteners. The ground surface may be sloped and the sign post may be in a vertical orientation.

DETAILED DESCRIPTION

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures associated with the technology have not been shown or described in detail to avoid unnecessarily obscuring descriptions of the embodiments.

Figure 1:
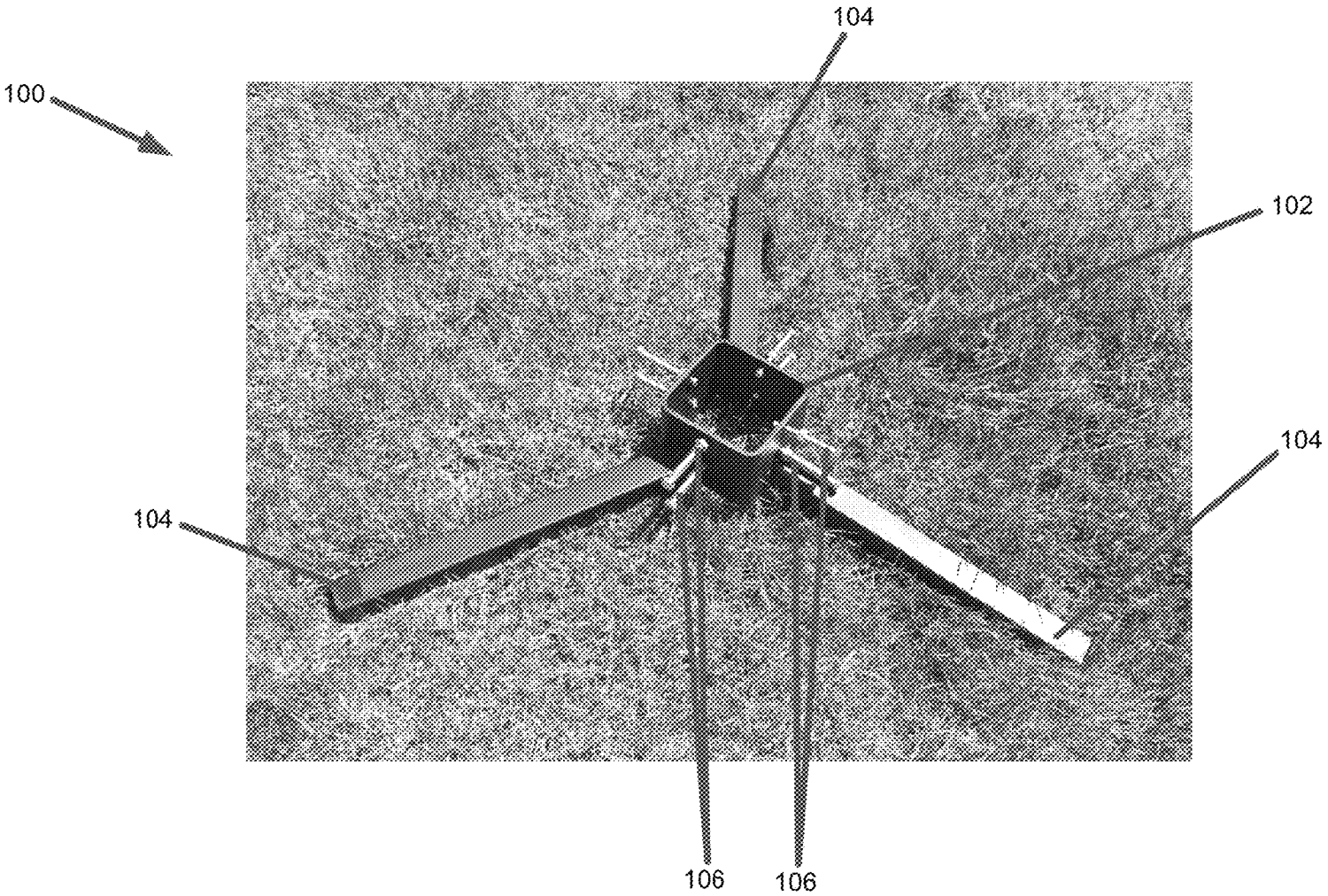
FIG. 1 illustrates a support system for a real estate sign post.

FIG. 1 illustrates a first example of a support system 100 for a real estate sign post that includes fully above ground support features. The support system 100 includes a central column 102 and a plurality of arms 104 that extend radially outward away from the central column 102. The central column 102 is hollow and includes a central open space that extends vertically through the column 102 from a bottom opening at a bottom end of the column 102 to a top opening at a top end of the column 102. The central column 102 has an inner surface that faces toward the central open space and an outer surface that faces away from the central open space. Cross-sectional shapes of the central column 102, its inner surface, and its outer surface, taken perpendicular to the central open space, include squares with rounded corners; however, other shapes are possible to accommodate different dimensions of the sign post. In this illustrated example, 5 inch square steel pipe is cut to prepare the central column 102. This includes rounded corners, where the opening may be 4¾ inches by 4¾ inches and an outer dimension of the square may be 5 inches by 5 inches.

The support system 100 includes a plurality of fasteners 106 extending through the central column 102. As illustrated, there are two fasteners 106 extending through each wall of the four side walls of the central column 102. Each wall may include only a single fastener or more than two fasteners. The support system 100 as illustrated is shaped to receive a 4 inch by 4 inch sign post, such that the sign post is positioned upright within the central open space of the central column 102. The fasteners 106 can be threaded through the side walls of the central column 102 to engage the sign post and restrain and stabilize the sign post in an upright position. Threading the fasteners 106 through the side walls of the central column 102 allows the support system 100 to support posts of various sizes and cross-sectional profiles as standard 4×4 lumber is not actually standard dimensions and ranges from 3.5 inches to 4.0 inches. The support system 100 holds a post in a vertical orientation even if the support system 100 is not level, such as by threading the fasteners 106 through the side walls of the central column 102 by different distances.

The system of FIG. 1 includes three arms 104 coupled to the central column 102 and extending radially outward from the central column. The arms are evenly spaced from each other to provide stability. The arms are formed so that at an angle of 120° is formed between each pair of adjacent arms 104 when the arms 104 are viewed from above. More arms may be included. The arms may be welded to the central column or attached in any suitable manner.

In some implementations, the arms 104 extend outward away from the central column 102 and vertically downward away from the central column 102, such that distal ends of the arms 104 are the only components of the support system 100 that touch the ground. In this configuration, a bottom surface of the central column is elevated from the ground and the distal ends (outermost ends) of the arms are touching the ground. In this configuration, the bottom of the sign post may rest on the ground, extending past the bottom surface of the central column. The arms 104 of the support system effectively form a tripod that supports the central column 102 above the ground, when the support system 100 is positioned on the ground. In other implementations, the arms 104 extend outward away from the central column 102 along respective orientations that are perpendicular to the central open space of the central column 102, so that the arms 104 are horizontal when the central column 102 is vertical.

Figure 2A:
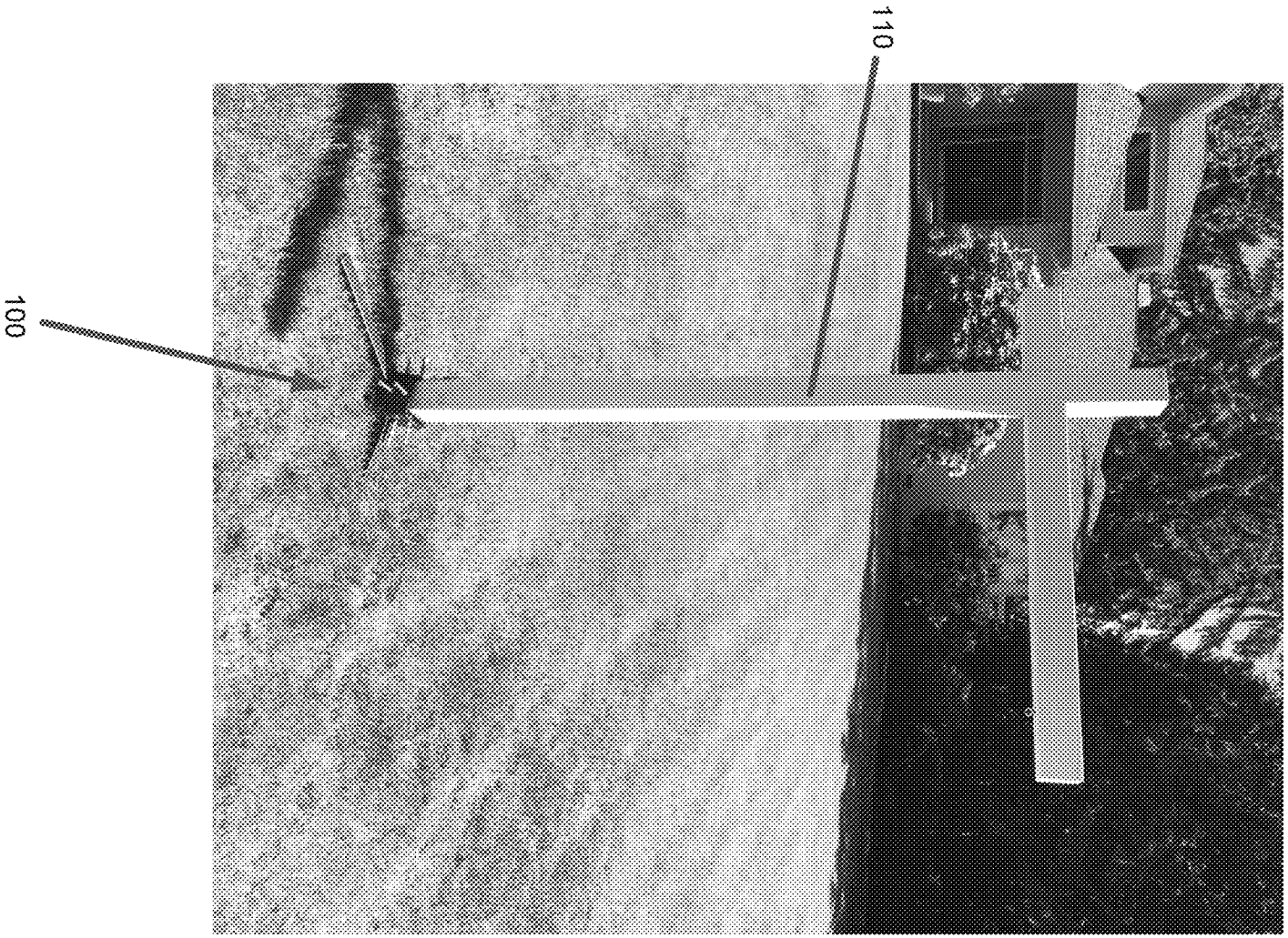
FIG. 2A illustrates a support system that includes internal plates supporting a real estate sign post.

FIG. 2A illustrates a variation of the support system 100 supporting a real estate sign post 110. This variation includes a plurality of plates positioned within the central column. Details of the plates are discussed more below. The arms of the support system 100 span a dimension sufficient enough to support the sign post, the arm transverse to the post that supports the sign, and the sign. A bottom surface of the post is coplanar with a first plane. Ends of the arms can be at different distances below this first plane as the ground on which the system is resting has different contours. The orientation of the bottom surface of the sign post dictates a position of the entire post.

FIGS. 2B, 2C, 2D, and 2E illustrate an enlarged view of the support system 100 of FIG. 2A. This variation of the support system 100 includes a plurality of metal plates that are positioned between proximal ends of the fasteners 106 and the real estate sign post 110 supported by the support system 100. These metal plates are used to protect the sign post 110 from damage that might occur if the proximal ends of the fasteners 106 engaged the sign post 110 directly, and to improve the security and stability of the engagement between the support system 100 and the sign post 110.

Figure 2B:
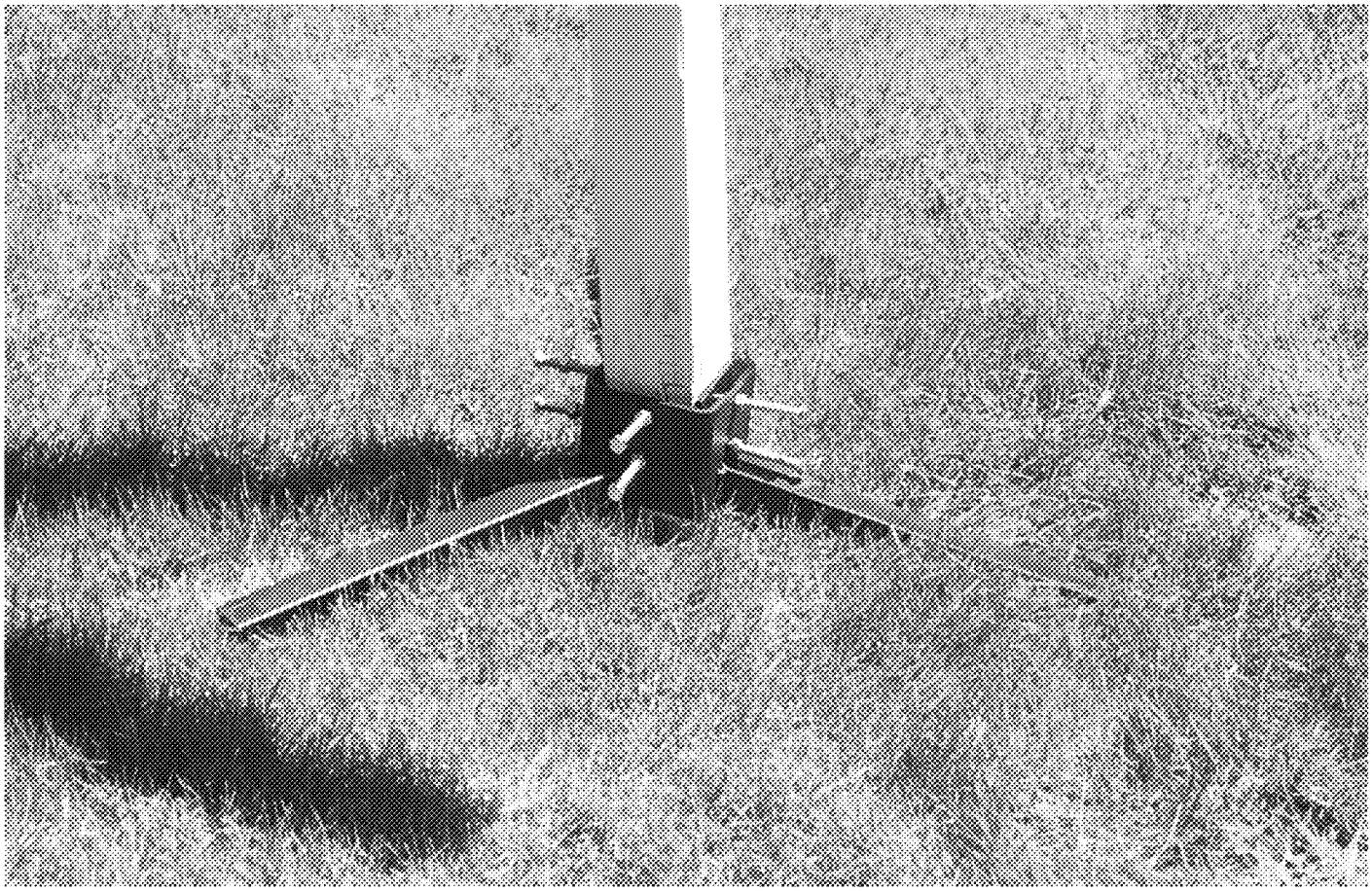
FIG. 2B illustrates another view of the support system of FIG. 2A.

FIG. 2B is an enhanced view of the system in FIG. 2A on a slightly sloped lawn. A leftmost plate in this image and the corresponding leftmost side of the sign post is very close to a leftmost side of the central column 102. A rightmost plate, a corresponding rightmost side of the sign post is spaced from a right most side of the central column 102. The orientation of these plates and the sign post is adjusted based on a slope, contour, or angle of the ground on which the system is resting. The fasteners are tightened to reduce the space between the sign post and the corresponding plate.

Figure 2C:
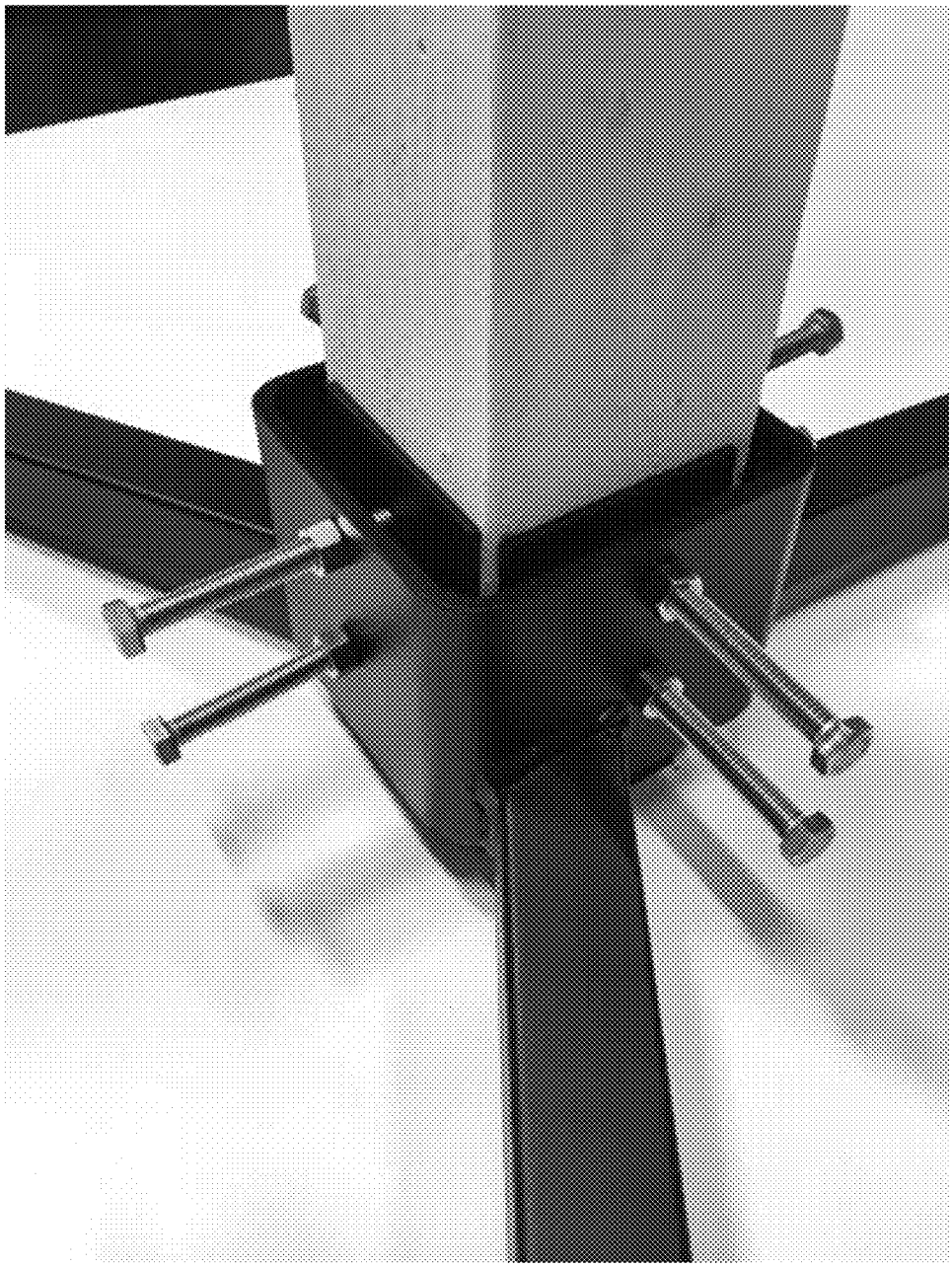
FIG. 2C illustrates another view of the support system of FIG. 2A.
Figure 2D:
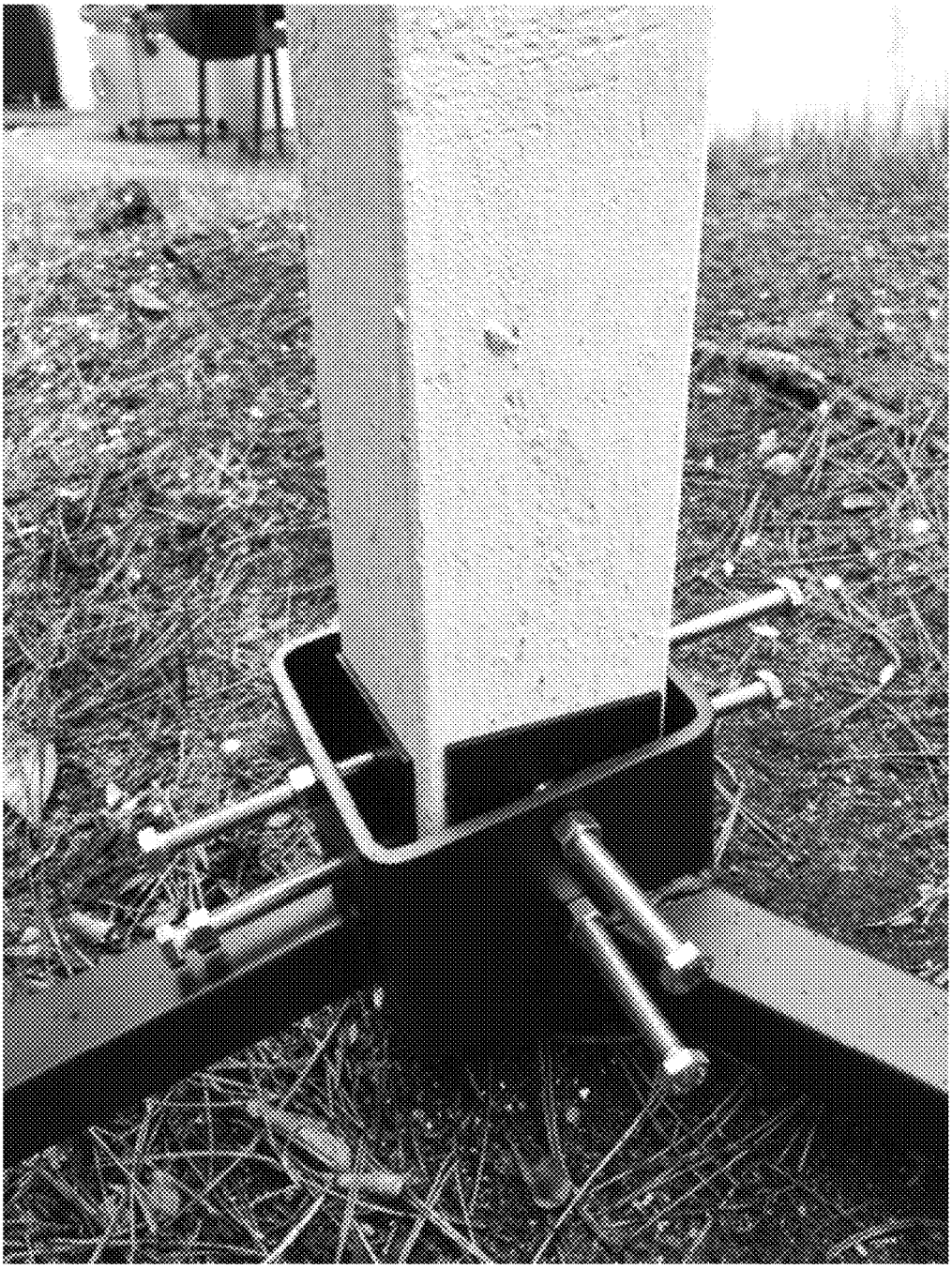
FIG. 2D illustrates another view of the support system of FIG. 2A.
Figure 2E:
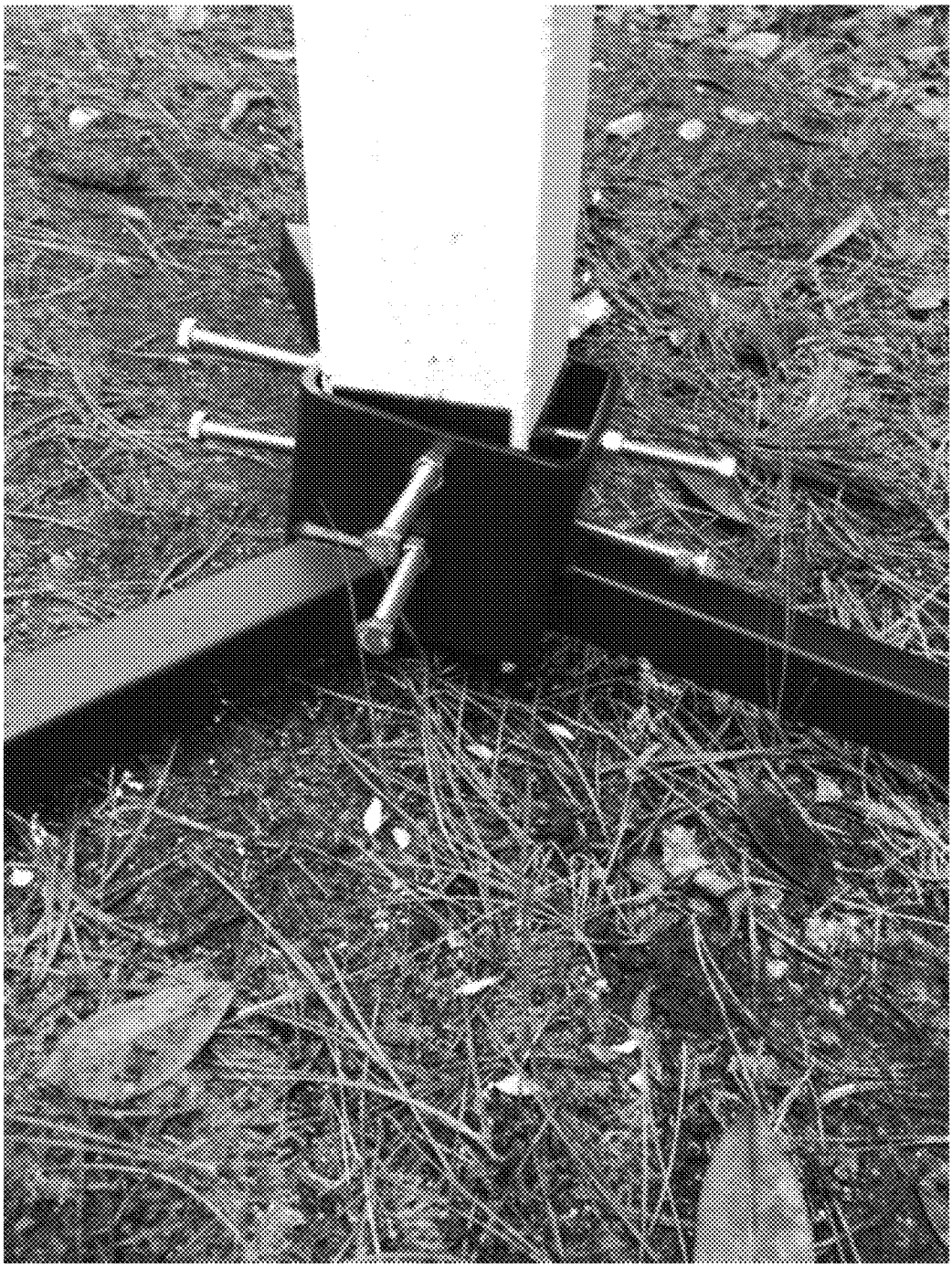
FIG. 2E illustrates another view of the support system of FIG. 2A.

FIGS. 2C-2E show relationships between the plates, the central column, and the sign post.

Figure 3:
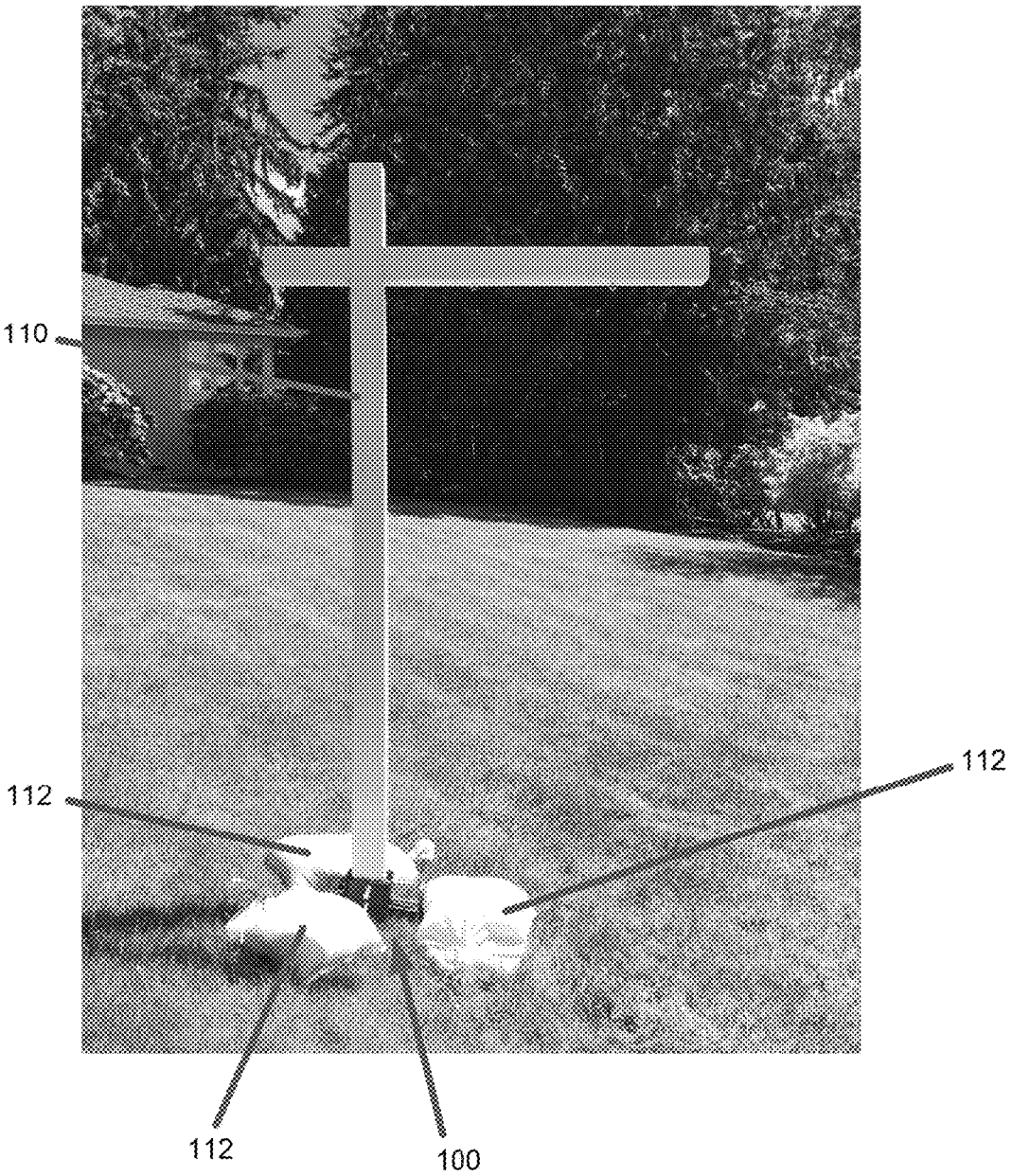
FIG. 3 illustrates the support system and sign post of FIG. 1 with weights positioned on the support system.
Figure 4A:
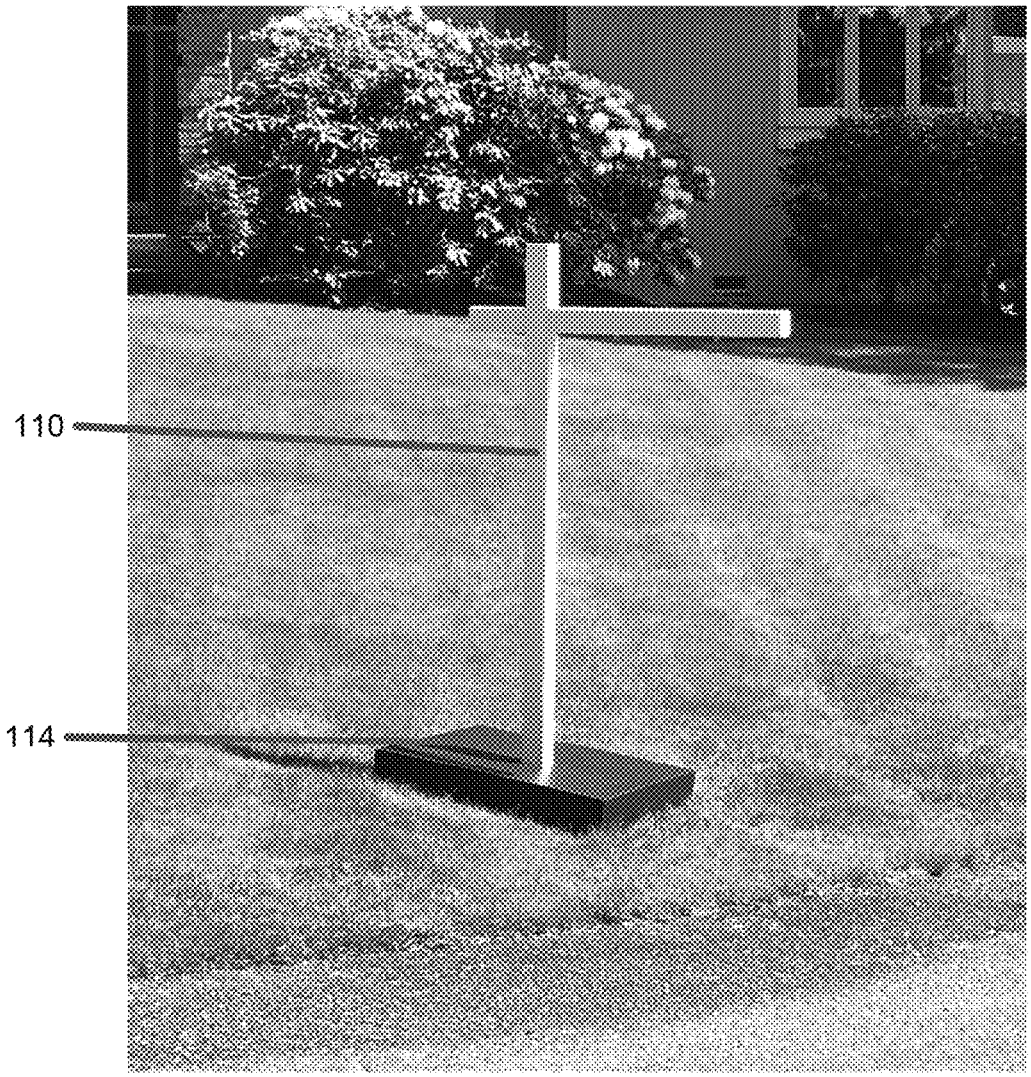
FIG. 4A illustrates a cover over the support system according to the various embodiments of this disclosure.
Figure 4B:
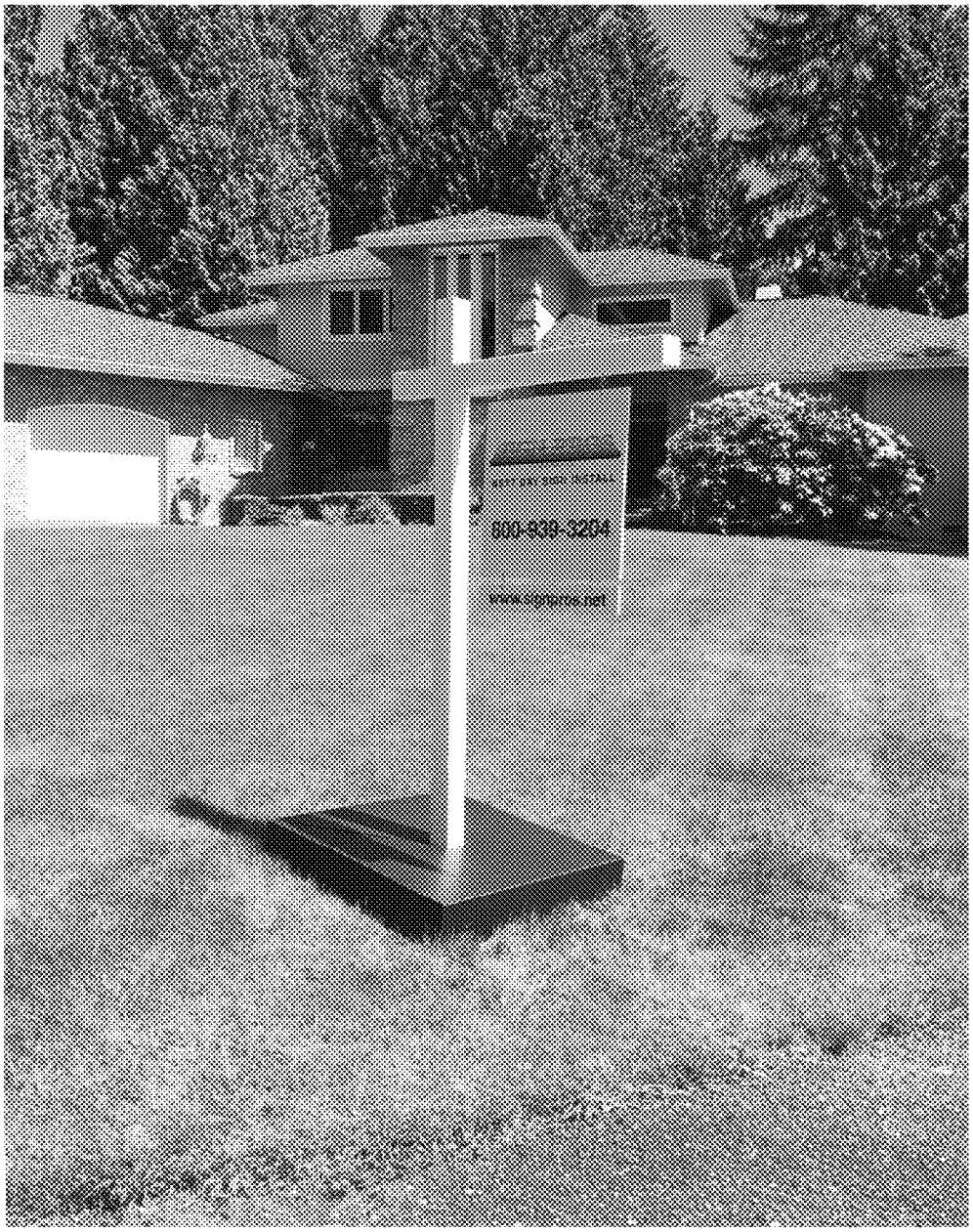
FIG. 4B illustrates the support system and sign post of FIG. 4A with a real estate sign hung from the real estate sign post.

FIGS. 3, 4A and 4B illustrate a kit for a sign post that includes the support system, weights, and a cover. To protect against tipping from wind or other factors, the support system can include weights positioned on the arms. In FIG. 3, the support system 100 supporting the real estate sign post 110 includes sandbags 112 positioned on the arms 104 of the support system 100. These sandbags further stabilize the support system 100 and the sign post 110.

FIG. 4A illustrates the support system 100 supporting the real estate sign post 110, with a cover 114 positioned over the support system 100 to protect the support system 100 from tampering and for aesthetic purposes. FIG. 4B illustrates the support system 100 supporting the real estate sign post 110 and a real estate sign hung from the real estate sign post 110. FIGS. 4A and 4B illustrate that the support system 100 can be used to support the real estate sign post 110 in a vertical orientation (i.e., plumb, or oriented parallel to a direction of gravity), even on a ground surface that is not planar or not level with respect to gravity. The cover may be any shape and size. The illustrated cover is about 6" and between 5.5 and 7.5 inches above the surface of the ground. The length and width may be 3 by 3 feet.

The support system is designed to replace in-ground real estate sign systems to avoid the need to call the excavating hotlines. The support system can support a variety of sign post heights. If a real estate agent desires to have the real estate sign look like an in-ground sign, which typically extends above the ground 5.5-6.5 feet, this sign support system can do so with less lumber. In-ground signs include 1-2 feet of lumber that is below the surface of the ground. The support system of the present application can use a 6.5-7.5 foot post, where around 6", or between 5.5 and 7.5 inches, or between 6 and 10 inches, are covered by the support system and the cover. Visually, 6-7 feet of the post will be visible. Any horizontal arm can be incorporated in the sign system. One option includes a four foot arm, where one foot extends from one side of the post and three feet extends from the other side of the arm. The arm and the post are integrally coupled together with interlocking cutouts.

A method of using the support system 100 can include positioning the support system 100 on the ground. The method can also include positioning a real estate sign post 110 into the central column 102 such that a bottom end of the sign post 110 rests on the ground, and then adjusting the fasteners 106 until the sign post 110 is secured within the support system 100 and aligned in a vertical direction so that it is plumb. The method can also include positioning sand bags 112 on the arms 104 of the support system 100 to prevent or reduce the chance of the sign post 110 tipping over, and then positioning a cover 114 over the support system 100 and the sand bags 112.

Figure 5:
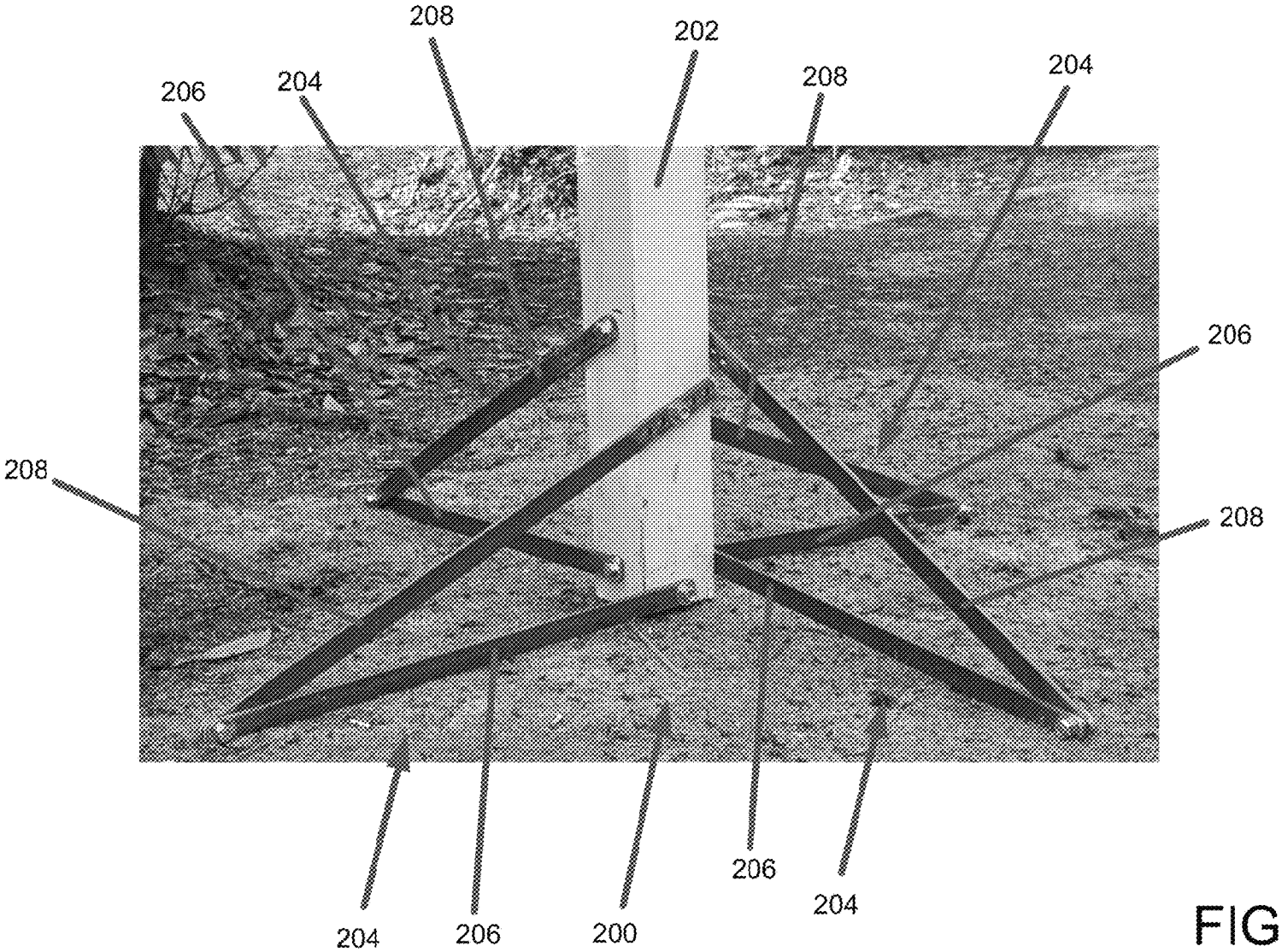
FIG. 5 illustrates a foldable support system for a real estate sign post coupled to a sign post.

FIG. 5 illustrates a foldable support system 200 coupled to a real estate sign post 202. As illustrated in FIG. 5, the support system 200 includes a plurality of triangular arms 204 that are coupled to and extend outward away from a bottom end portion of the sign post 202. In the embodiment illustrated in FIG. 5, the plurality of triangular arms 204 includes four triangular arms 204. Each of the triangular arms 204 is coupled to a respective side surface of the sign post 202 and extends away from the sign post 202 in a direction parallel to the respective side surface.

In particular, each of the triangular arms 204 includes a bottom bar 206 that is fastened at a proximal end to, and that extends horizontally outward from, a bottom end portion of the sign post 202. Each of the triangular arms 204 also includes a top bar 208 that includes a plurality of through-holes at its proximal end, and that is fastened at its proximal end to the sign post 202 at a location above the respective bottom bar 206. Each top bar 208 extends horizontally outward and downward from the sign post 202, and is fastened at a distal end to a distal end of the bottom bar 206. By selecting one of the plurality of through holes at the proximal end of the top bar 208 for fastening by a bolt or other fastener to the sign post 202, a user can control an angle of the bottom bar with respect to the sign post 202. Thus, each of the triangular arms 204 has a triangular shape defined by the respective bottom bar 206, the respective top bar 208, and the portion of the sign post 202 extending between the proximal end of the bottom bar 206 and the proximal end of the top bar 208.

Figure 6:
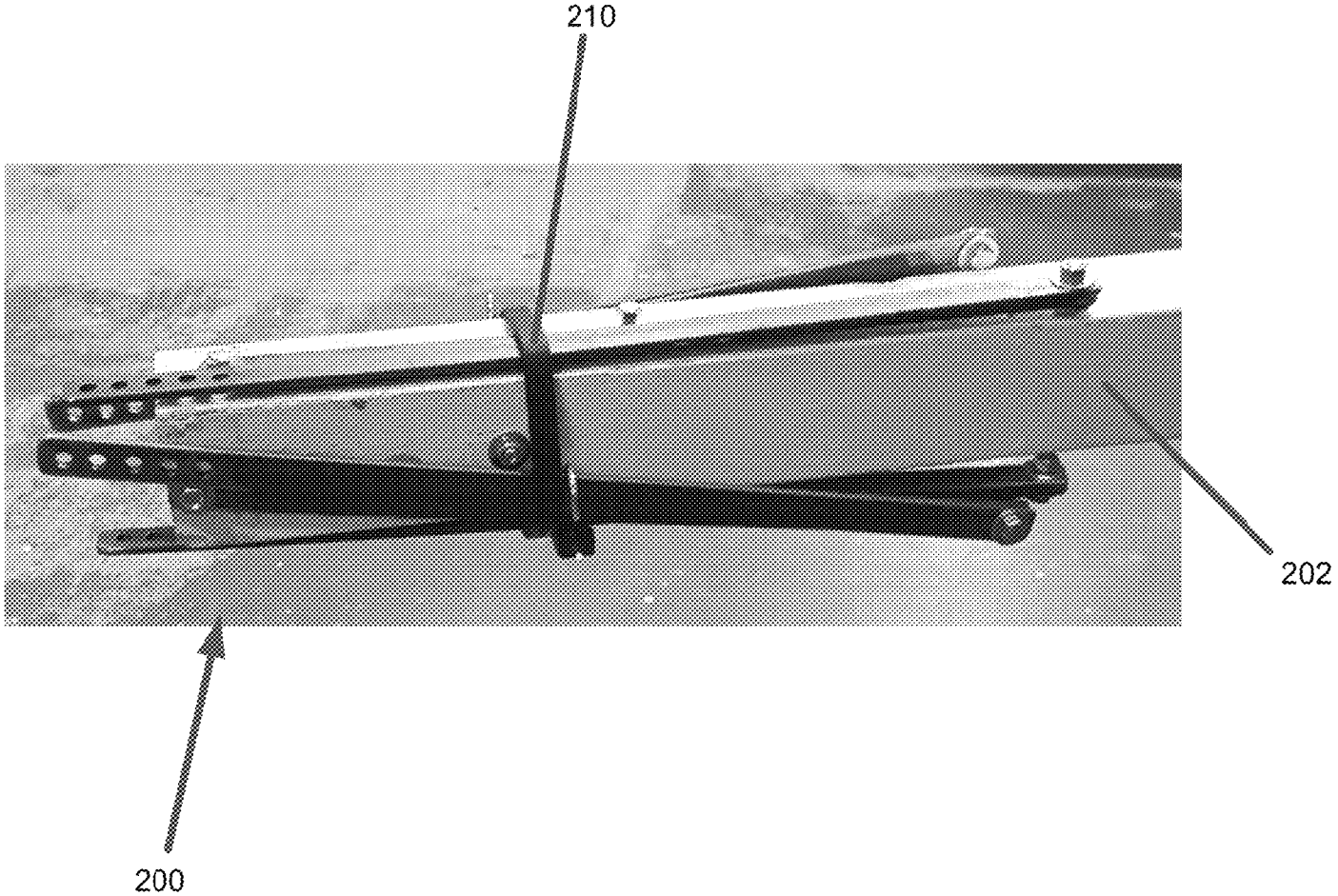
FIG. 6 illustrates the support system and sign post of FIG. 5, with the support system in a folded configuration.

FIG. 6 illustrates the support system 200 and the sign post 202, with the support system 200 in a folded configuration and a strap 210 holding the folded support system 200 against the side surfaces of the sign post 202. To fold the support system 200 as illustrated in FIG. 5 against the side surfaces of the sign post 202 as illustrated in FIG. 6, the top bars 208 can be unfastened from the side surfaces of the sign post 202, and then the bars 206 and 208 can be folded inward toward the sign post 202. The strap 210 can then be applied to secure the folded bars 206 and 208 to the side surfaces of the sign post 202.

A method of using the support system 200 can include shipping the support system 200 in the folded configuration illustrated in FIG. 6. The method can also include removing the strap 210 from the folded support system 200 and the sign post 202, and then positioning the sign post in a desired location. The method can also include fastening the proximal ends of the top bars 208 to the sign post 202 to form the four triangular arms 204 to support the sign post 202.

Figure 7:
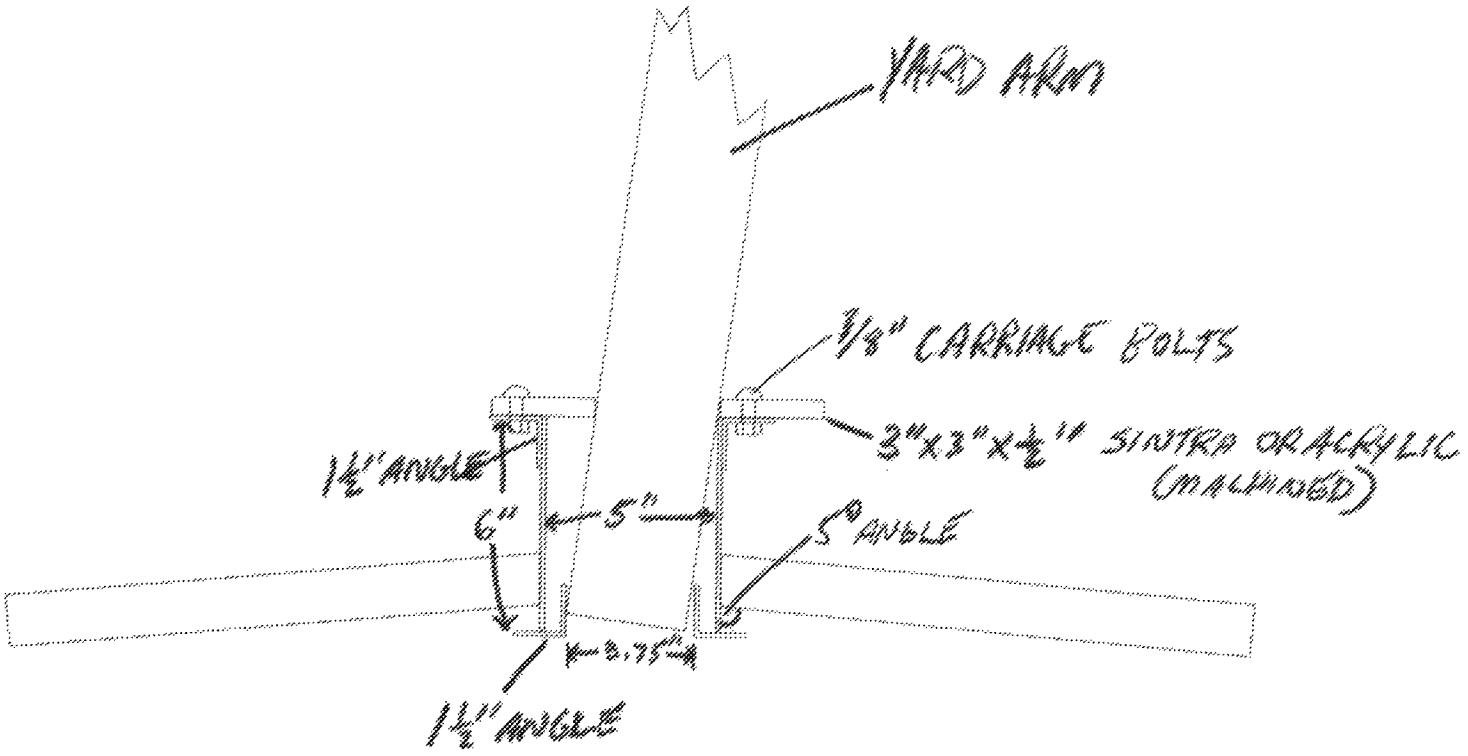
FIG. 7 illustrates a cross-sectional side view of another support system for a real estate sign post.
Figure 8:
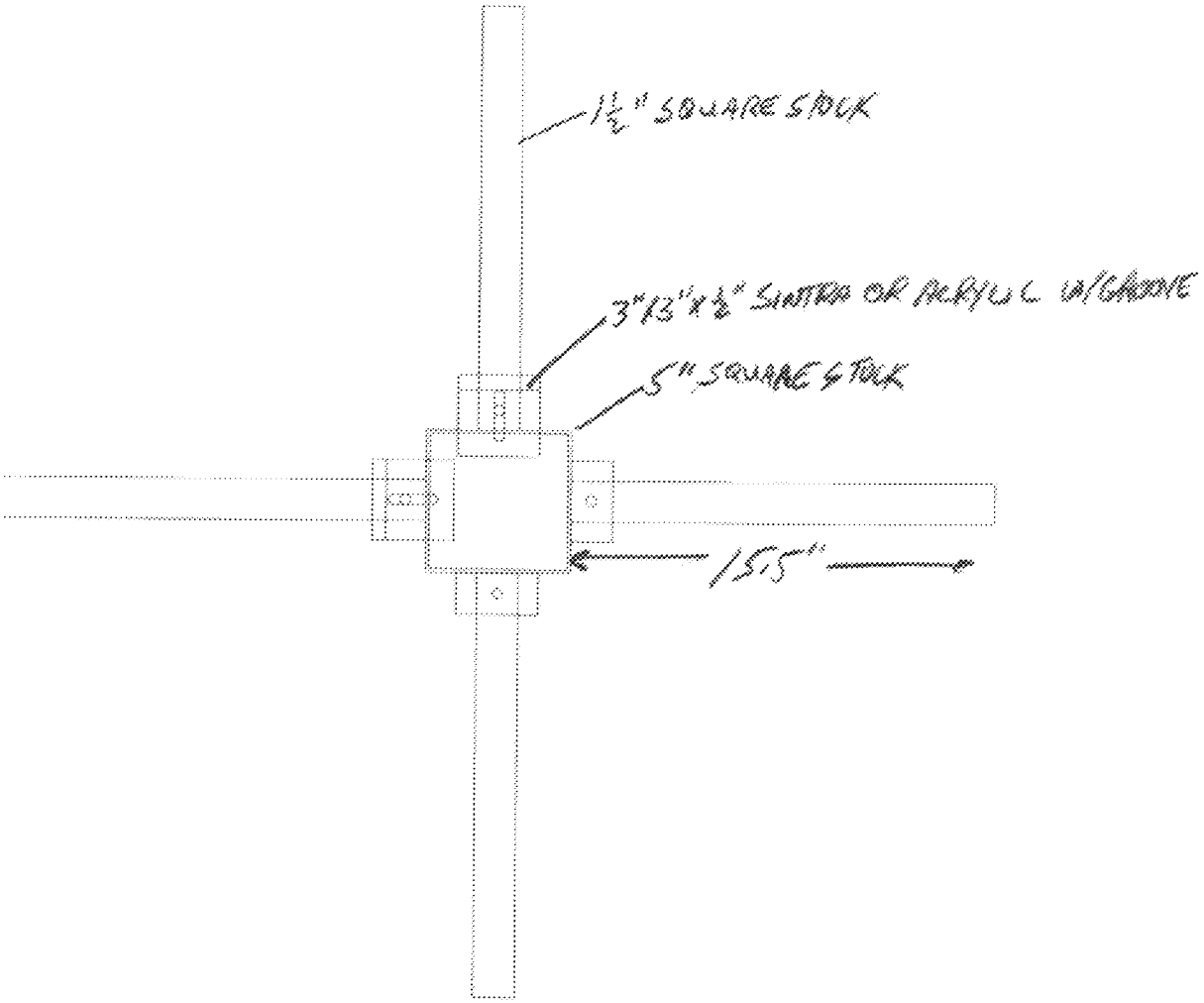
FIG. 8 illustrates a top plan view of the support system of FIG. 7.
Figure 9:
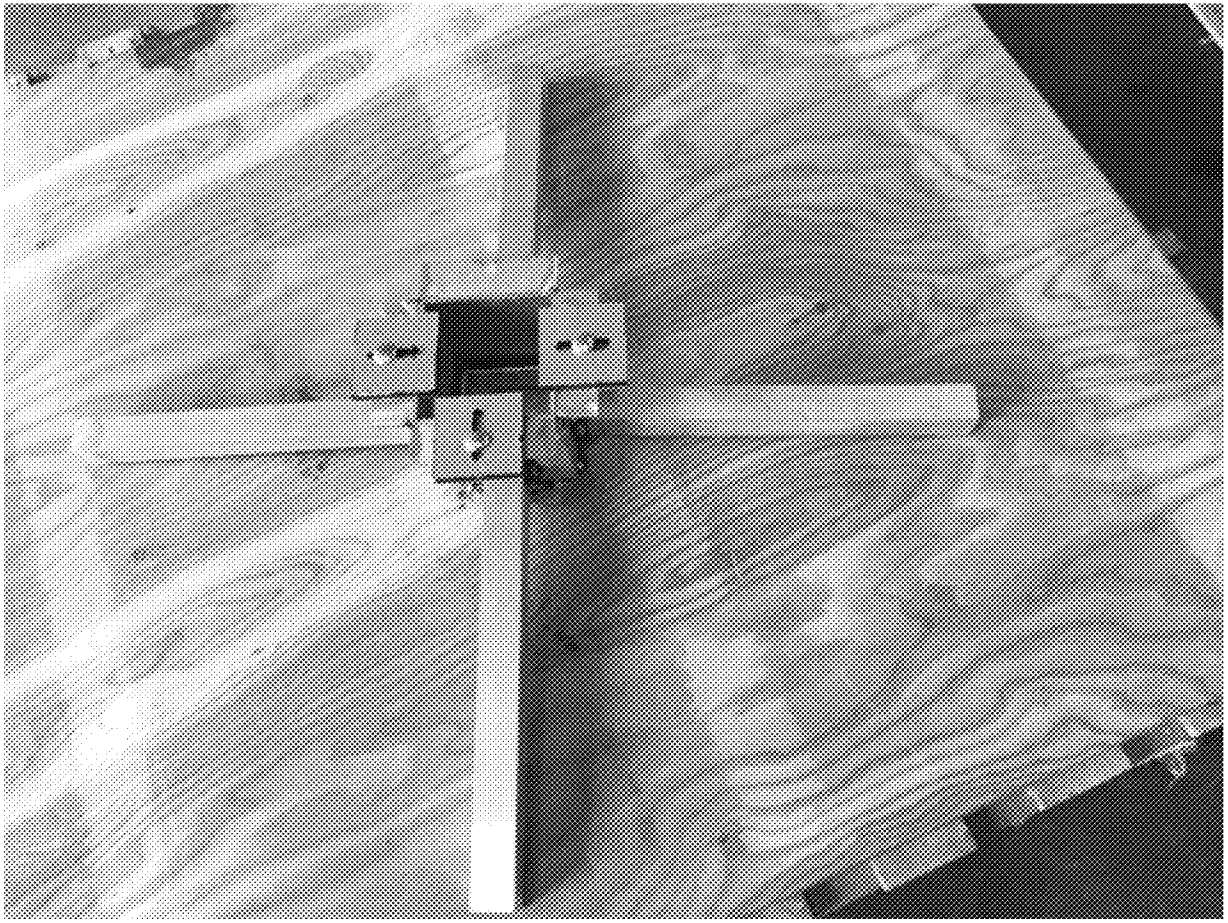
FIG. 9 illustrates a perspective view of another support system for a real estate sign post.
Figure 10:
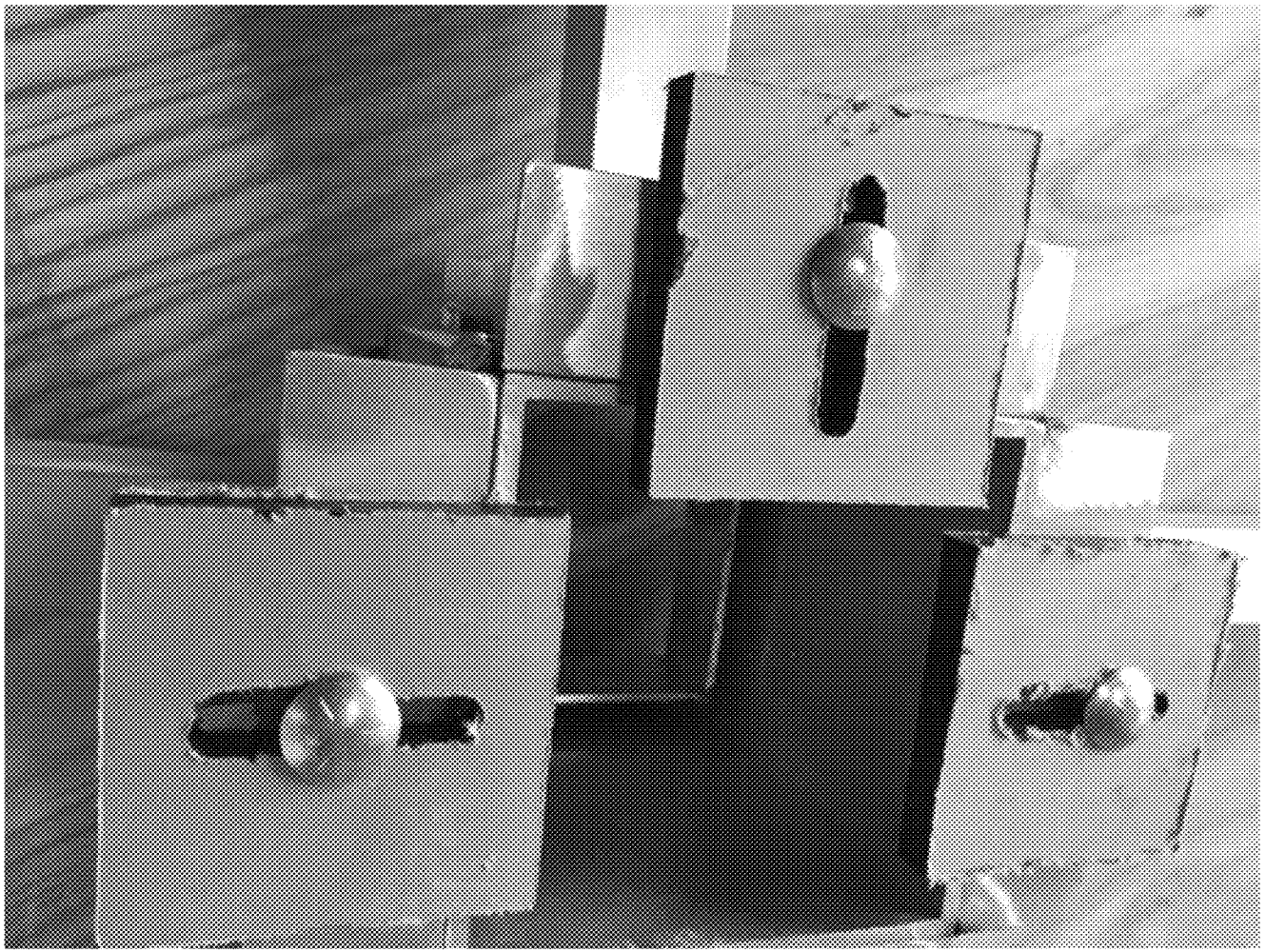
FIG. 10 illustrates another view of the support system of FIG. 9.
Figure 11:
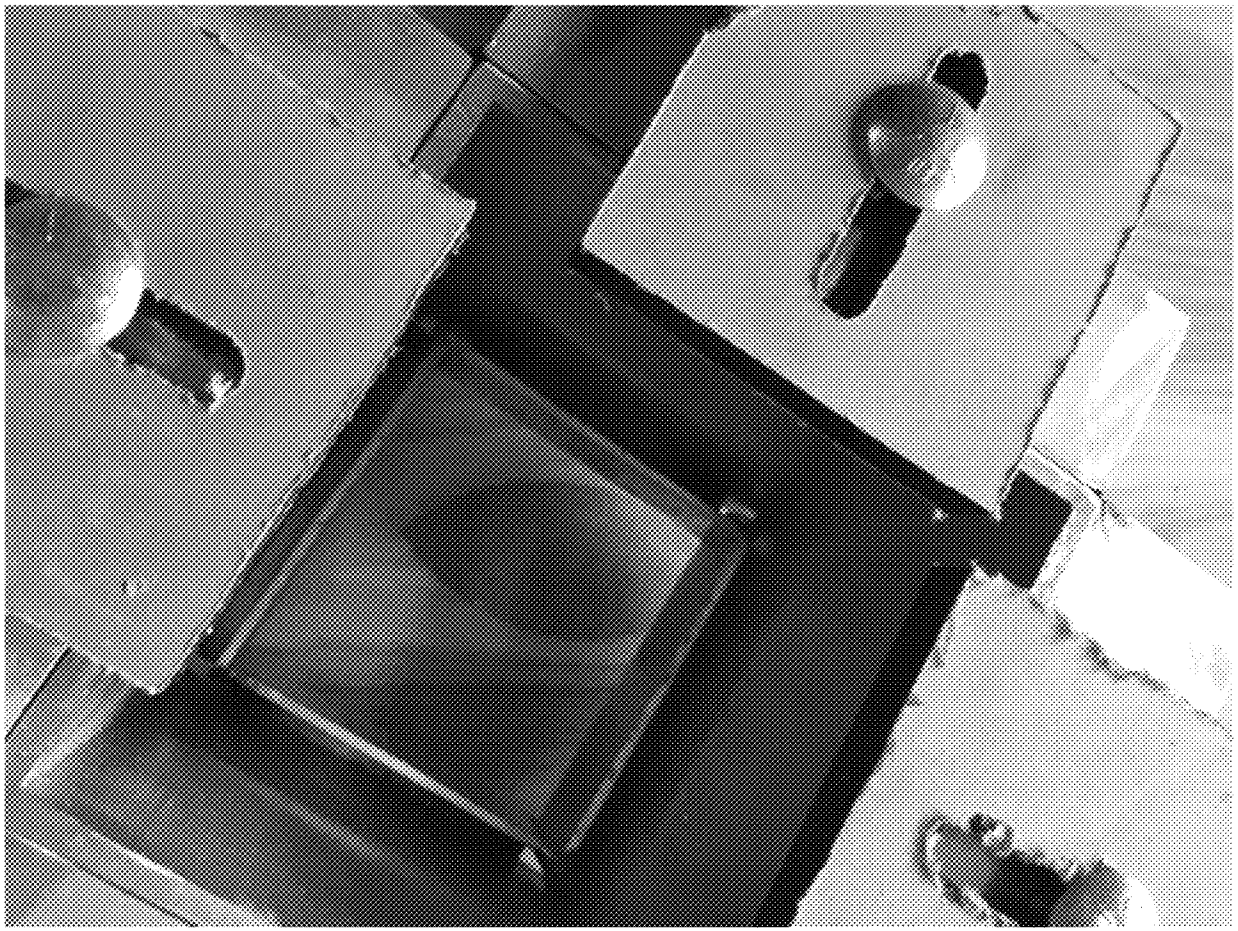
FIG. 11 illustrates another view of the support system of FIG. 9.

FIGS. 7 and 8 illustrate a cross-sectional side view and a top plan view, respectively, of another embodiment of a support system for a real estate sign post. The support system of FIGS. 7 and 8 does not include horizontal fasteners such as the fasteners 106 described above, and instead includes a plurality of horizontal plates (two are illustrated) with slots formed therein, which can slide along respective vertical fasteners that can be tightened to secure the plates to the rest of the support system once the plates are positioned in desired locations to support a real estate sign post. The support system of FIGS. 7 and 8 also includes a plurality of angle brackets coupled to its bottom end, to more securely restrain the bottom end of a real estate sign post. FIGS. 9-11 illustrate a support system similar to the support system of FIGS. 7 and 8, with three of the horizontal plates illustrated.

Figure 12:
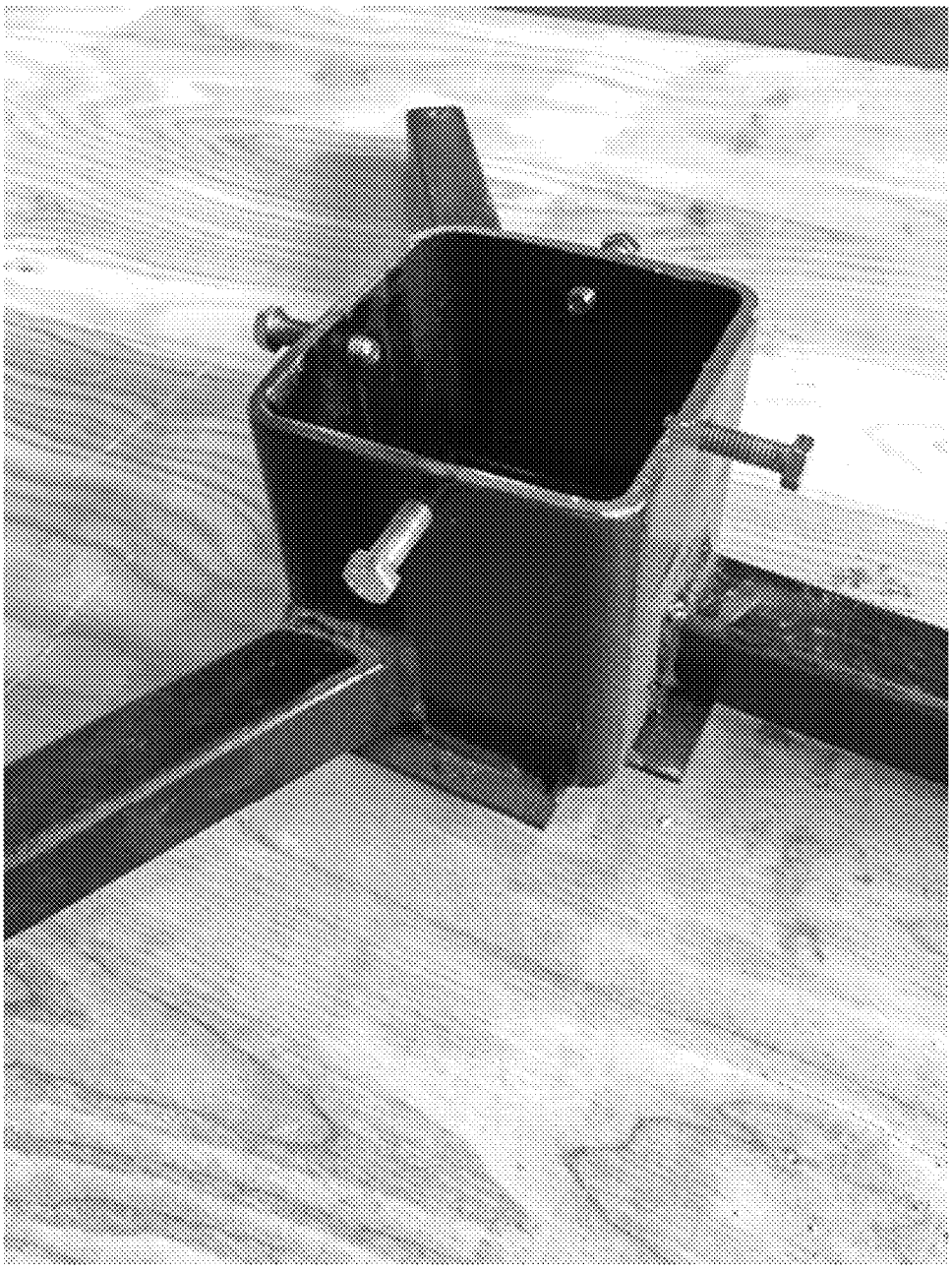
FIG. 12 illustrates a top perspective view of another support system for a real estate sign post.
Figure 13:
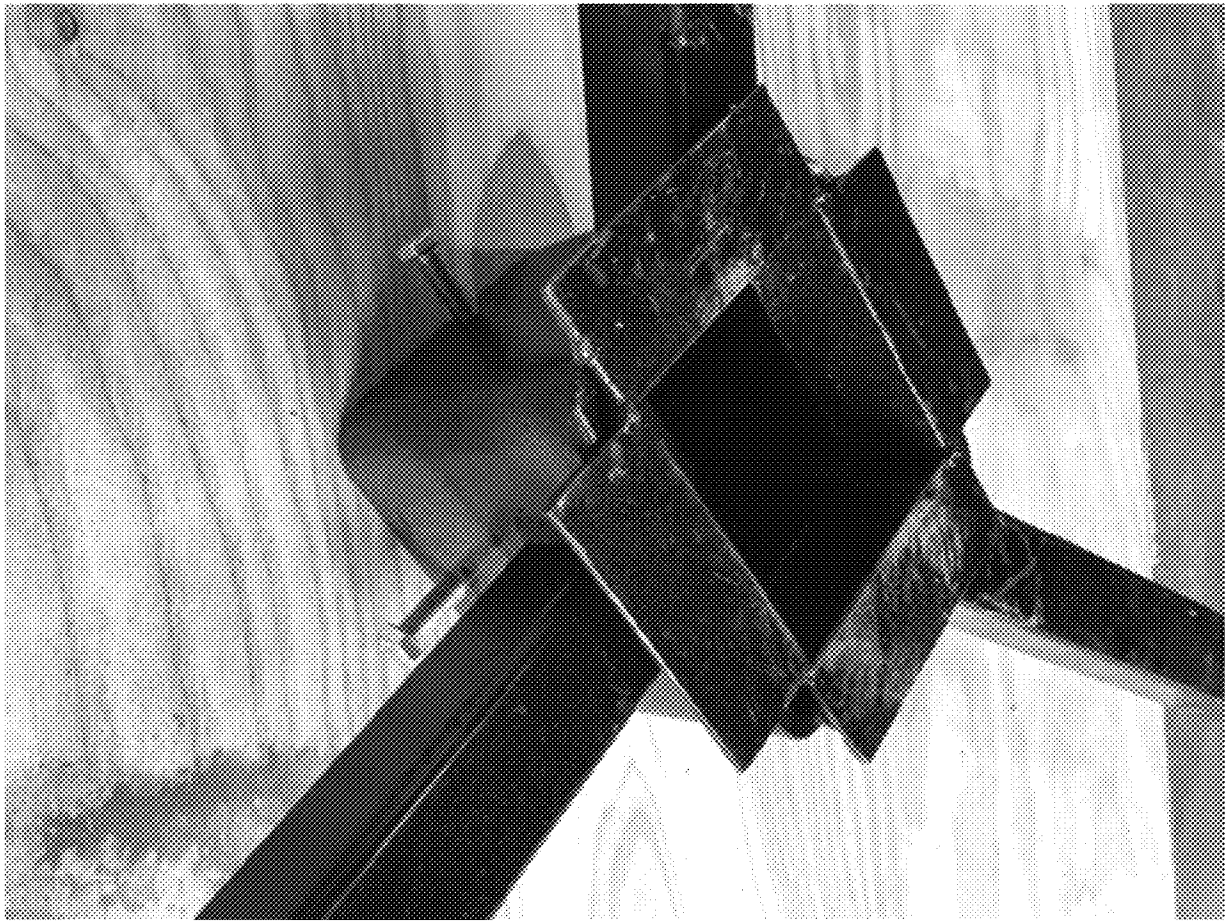
FIG. 13 illustrates a bottom perspective view of the support system of FIG. 12.
Figure 14:
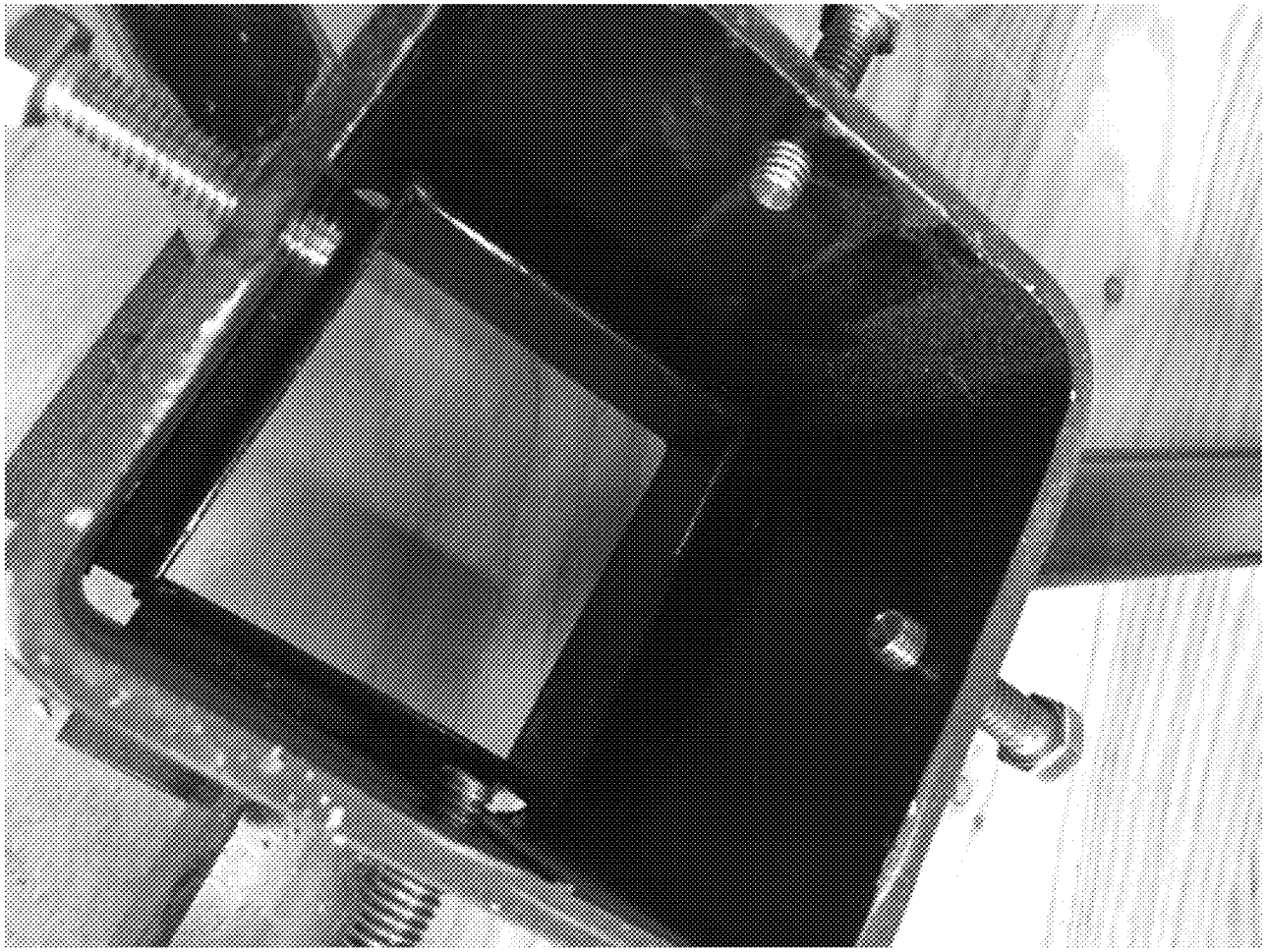
FIG. 14 illustrates another view of the support system of FIGS. 12 and 13.

FIGS. 12-14 illustrate various perspective views of another embodiment of a support system for a real estate sign post that includes features of the system 100 and the system of FIGS. 7 and 8, as described above. Notably, the system of FIGS. 12-14 includes one fastener extending through each of four side walls of a central column of the support system, rather than two, as described above for system 100.

Figure 15:
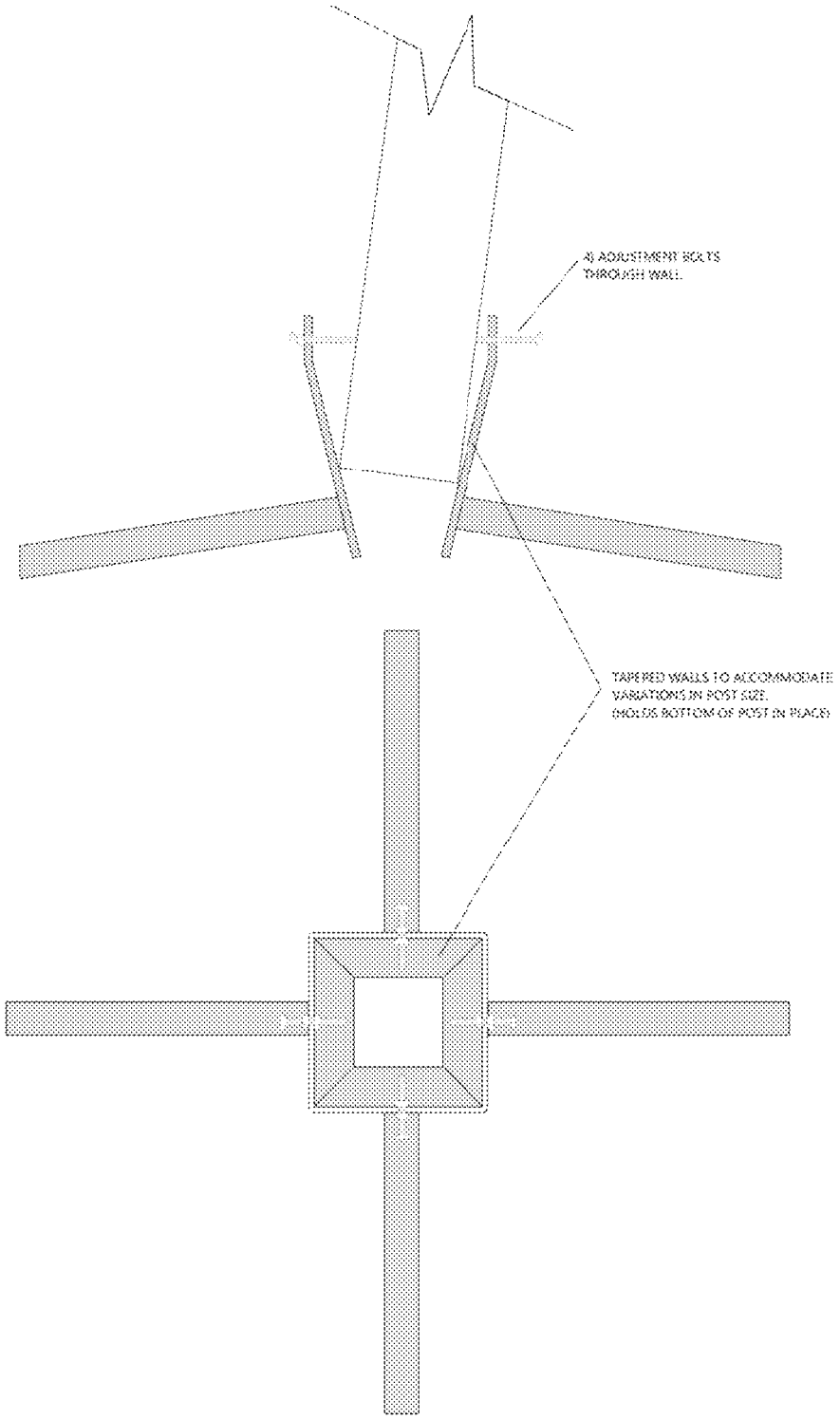
FIG. 15 illustrates a cross-sectional side view and a top plan view of another support system for a real estate sign post.

FIG. 15 illustrates another support system for real estate sign posts, which includes a funnel-shaped or tapered central column and a corresponding funnel-shaped or tapered central open space, which can be advantageous because it can support the bottom end of a wide variety of sizes of sign posts. A single fastener per each side of the support is illustrated. More fasteners per each side can be included. This variation includes four arms extending perpendicularly from the central column. The arms may be welded the corners of the central column as an alternative.

Figure 16:
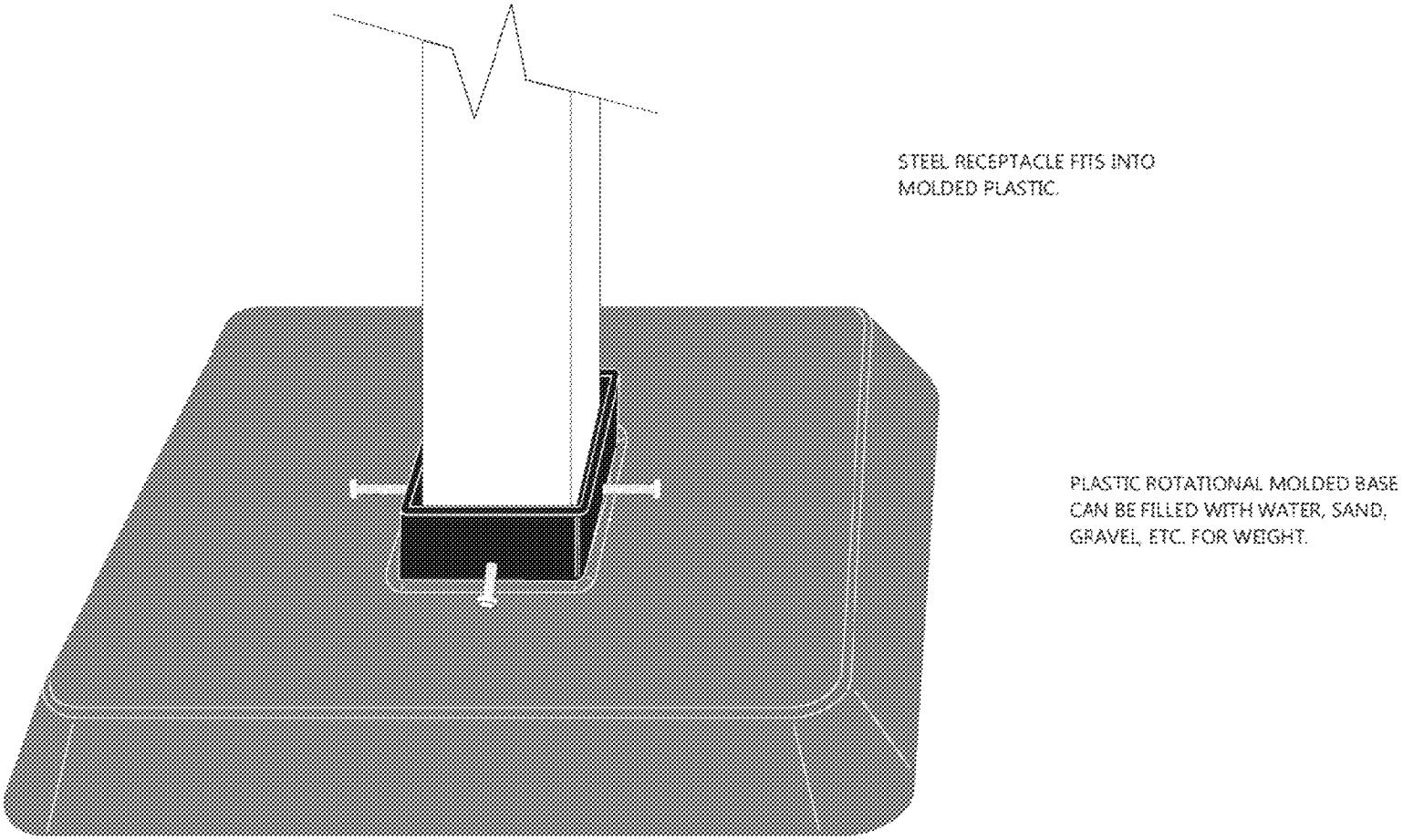
FIG. 16 illustrates perspective view of another support system for a real estate sign post.
Figure 17:
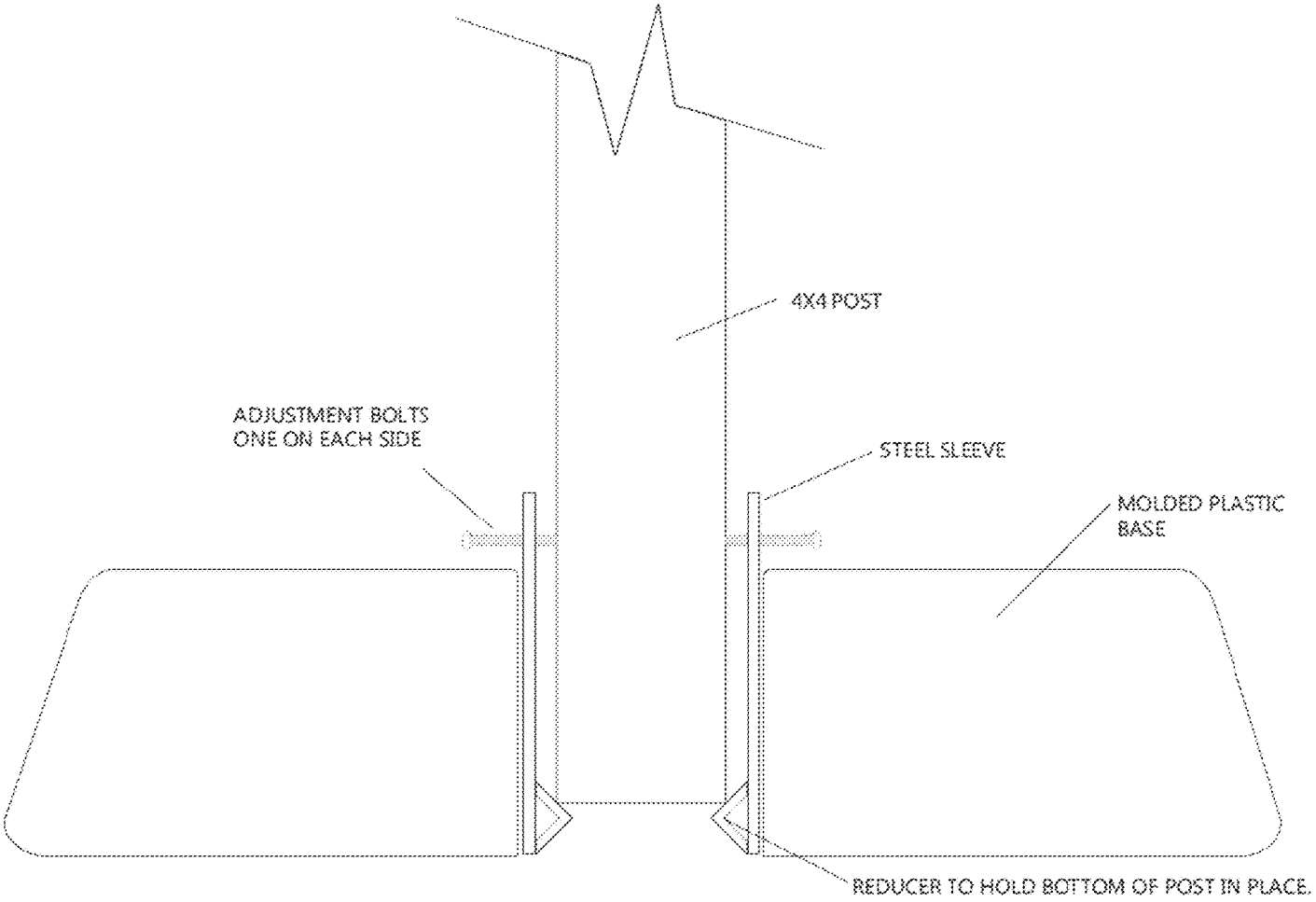
FIG. 17 illustrates a cross-sectional side view of the support system of FIG. 16.

FIGS. 16 and 17 illustrate another support system for real estate sign posts, which includes a hollow base portion, which can be referred to as a "molded base," that includes an annular open space or cavity that can be filled with heavy materials (e.g., sand, water, gravel, etc.) in order to provide additional support and stability to the real estate sign post it supports. The support system of FIGS. 16 and 17 also include a central column that has a funnel-shaped or tapered bottom portion similar to but smaller than that of the support system of FIG. 15. This may be manufactured as a single, stand-alone solution where the sleeve formed by the central column is fixed within the molded plastic base. At a location closer to the ground, the central column may include a support prong to support the bottom surface of the sign. The support prong is triangular in cross-section, but may be other shapes, such as rectangular. The triangular shape accommodates different sized sign posts. Above a top surface of the molded base, fasteners are included to couple the sleeve to sides of the post.

Figure 18:
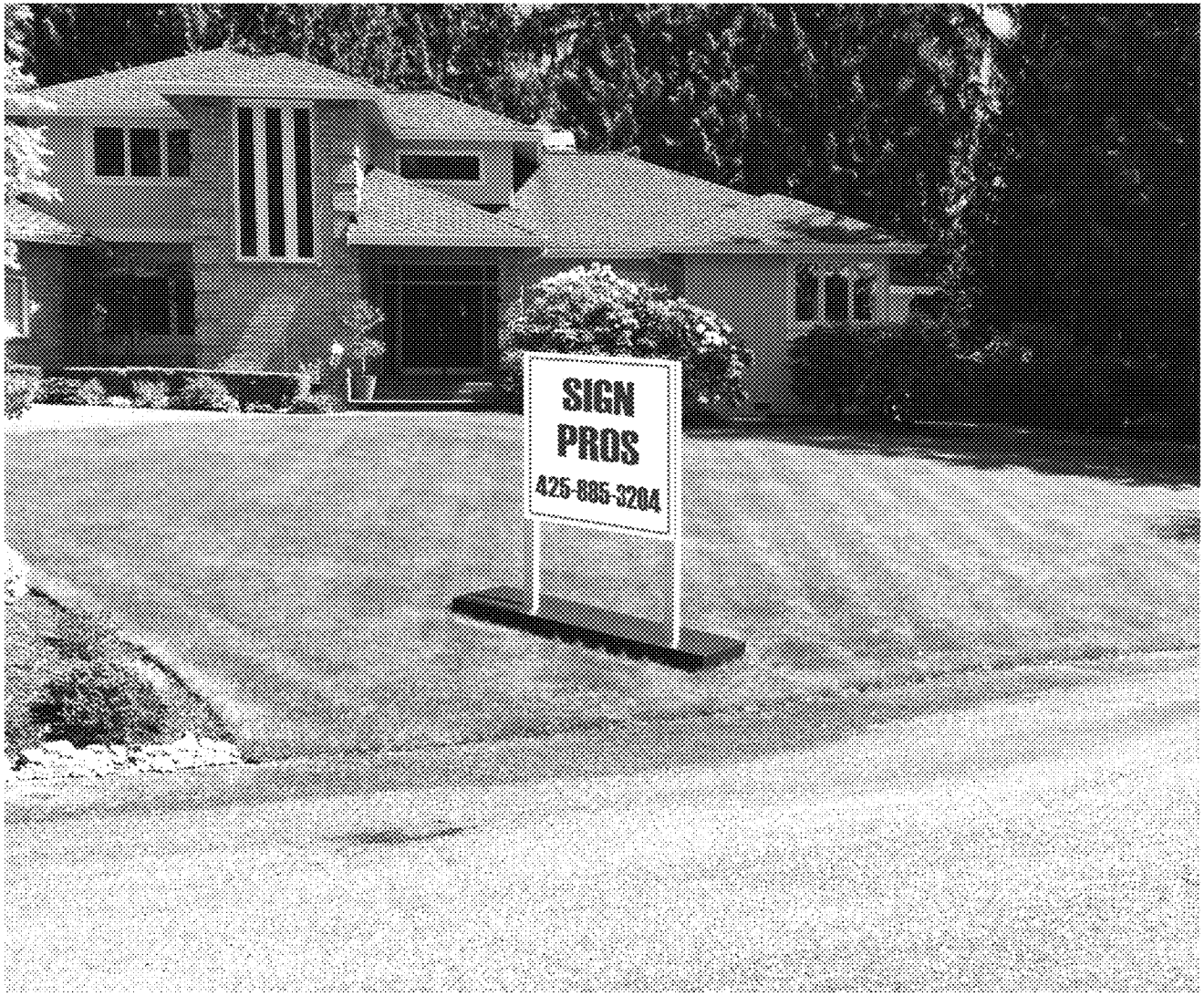
FIG. 18 illustrates a real estate sign with two sign posts supported by systems in accordance with the present disclosure.
Figure 19:
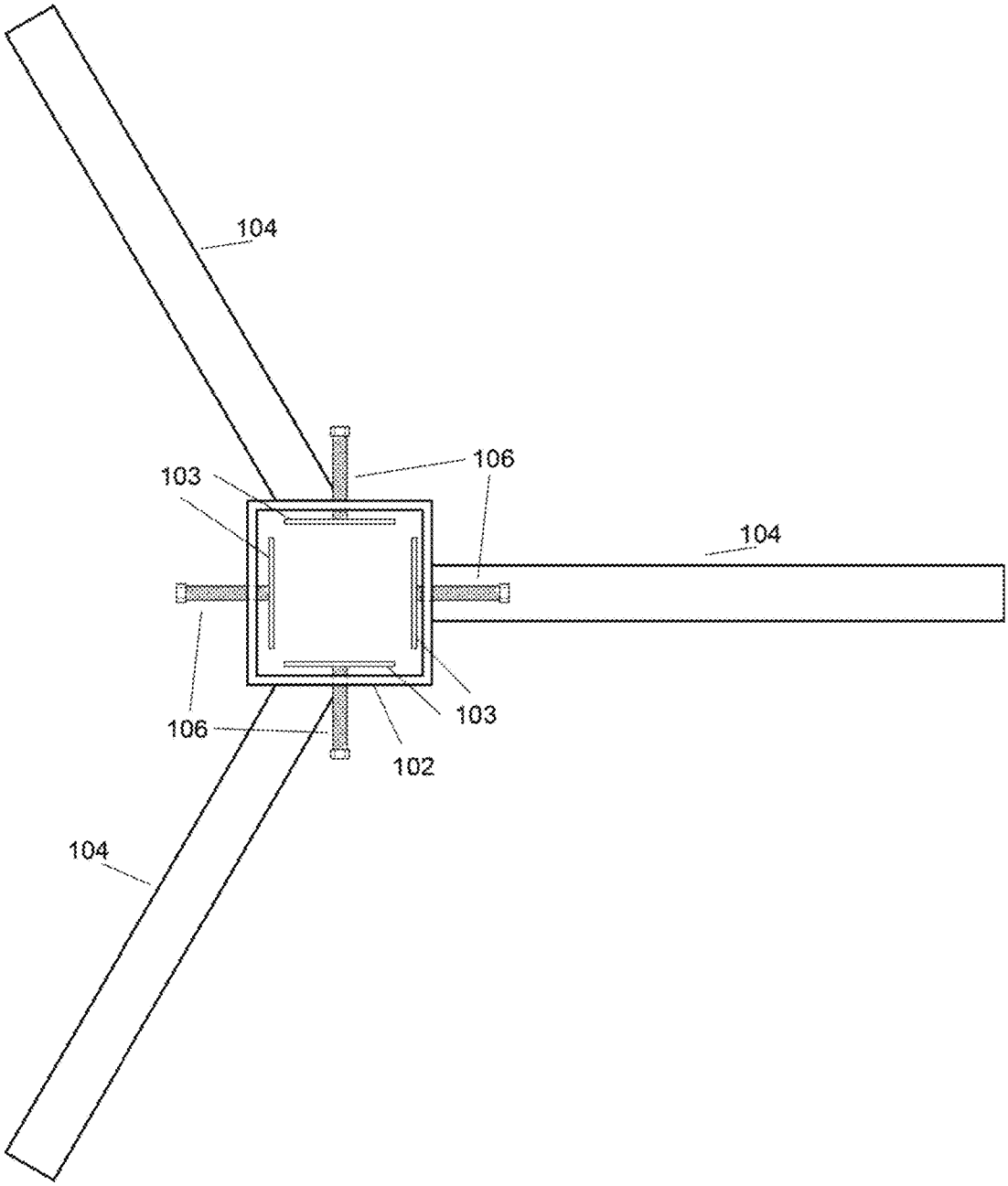
FIG. 19 illustrates a top view of the support system of FIGS. 2A-2E.
Figure 20:
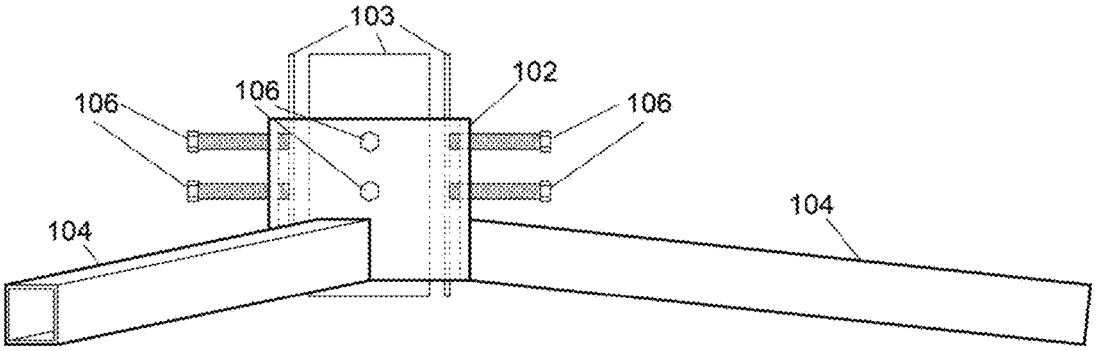
FIG. 20 illustrates a side view of the support system of FIGS. 2A-2E.
Figure 21:
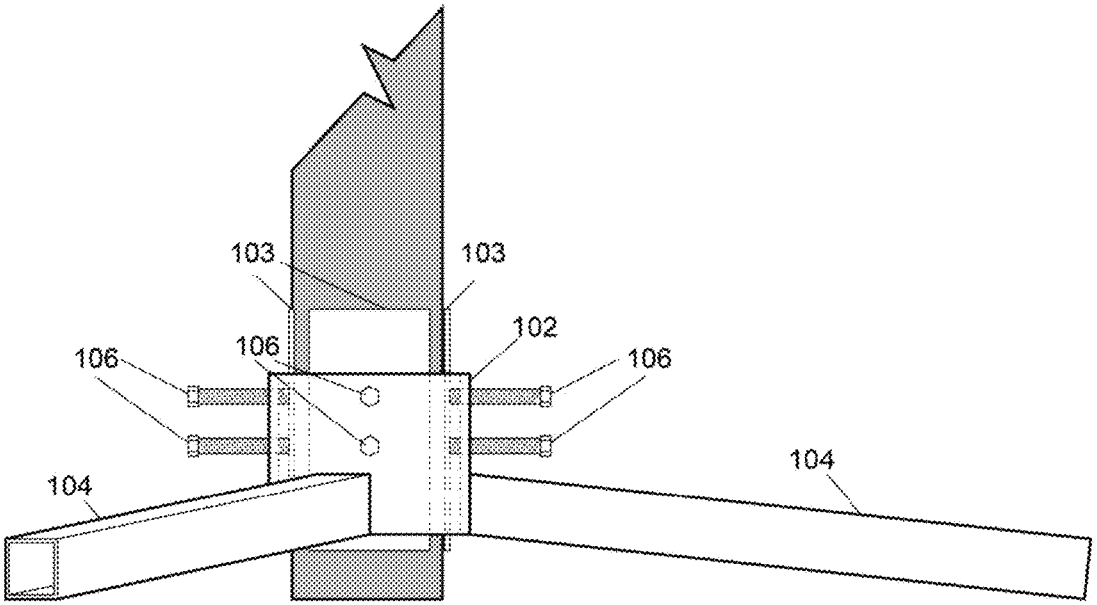
FIG. 21 illustrates a side view of the support system of FIGS. 2A-2E with a sign post installed within the support system.
Figure 22:
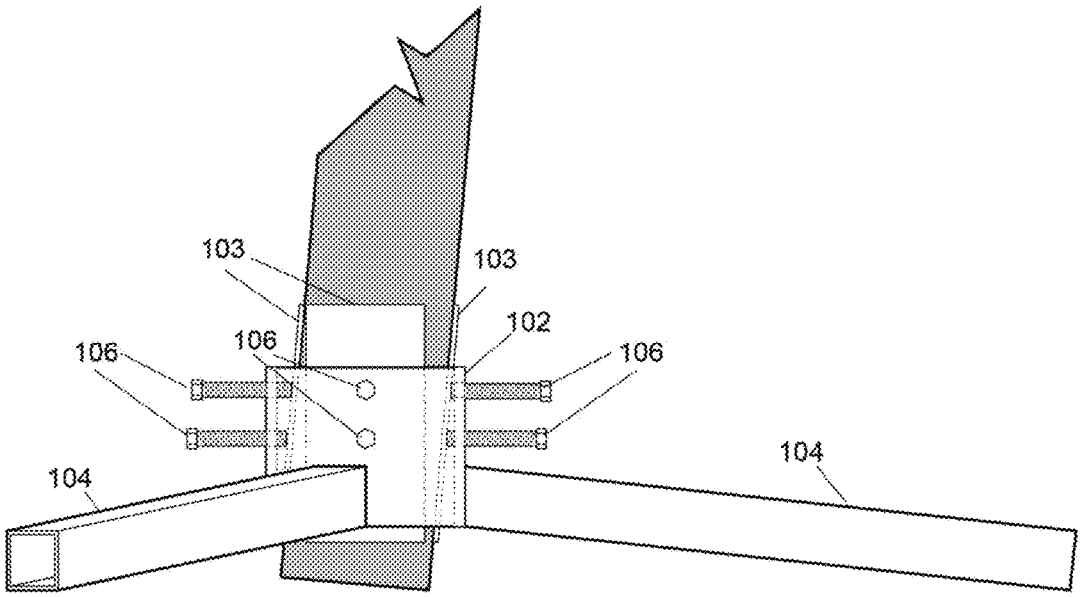
FIG. 22 illustrates a side view of the support system of FIGS. 2A-2E with a sign post installed at an angle within the support system.
Figure 23:
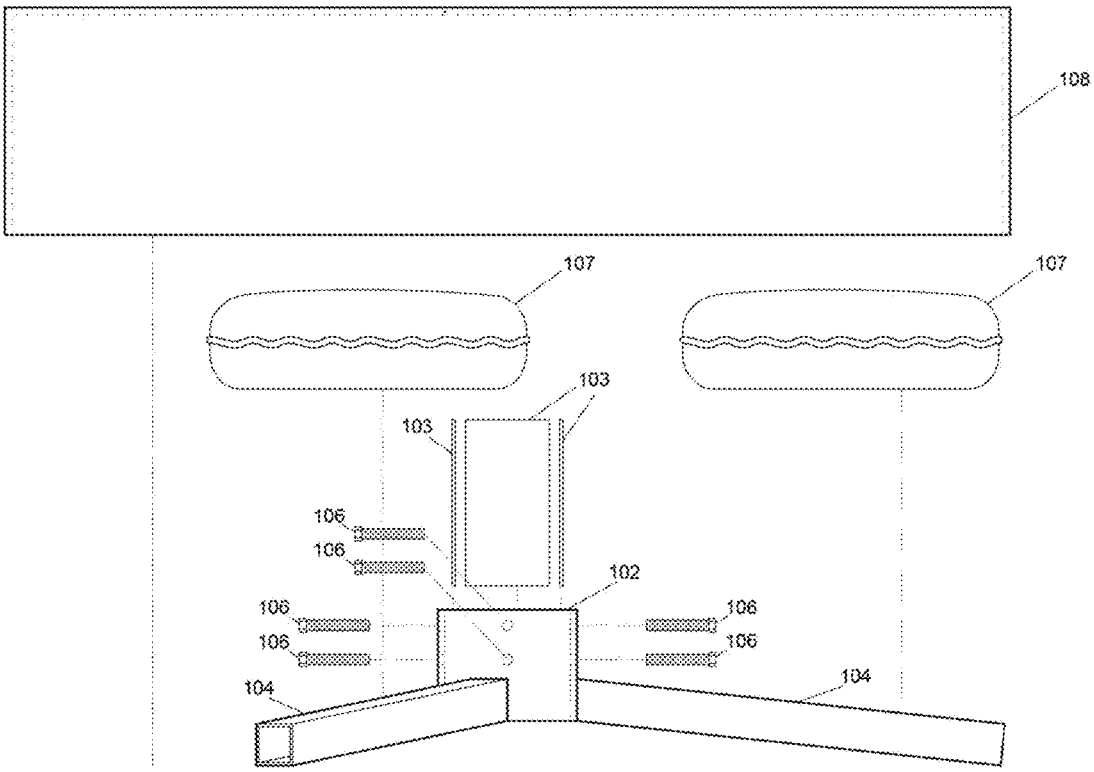
FIG. 23 illustrates an exploded view of the support system of FIGS. 2A-2E.
Figure 24:
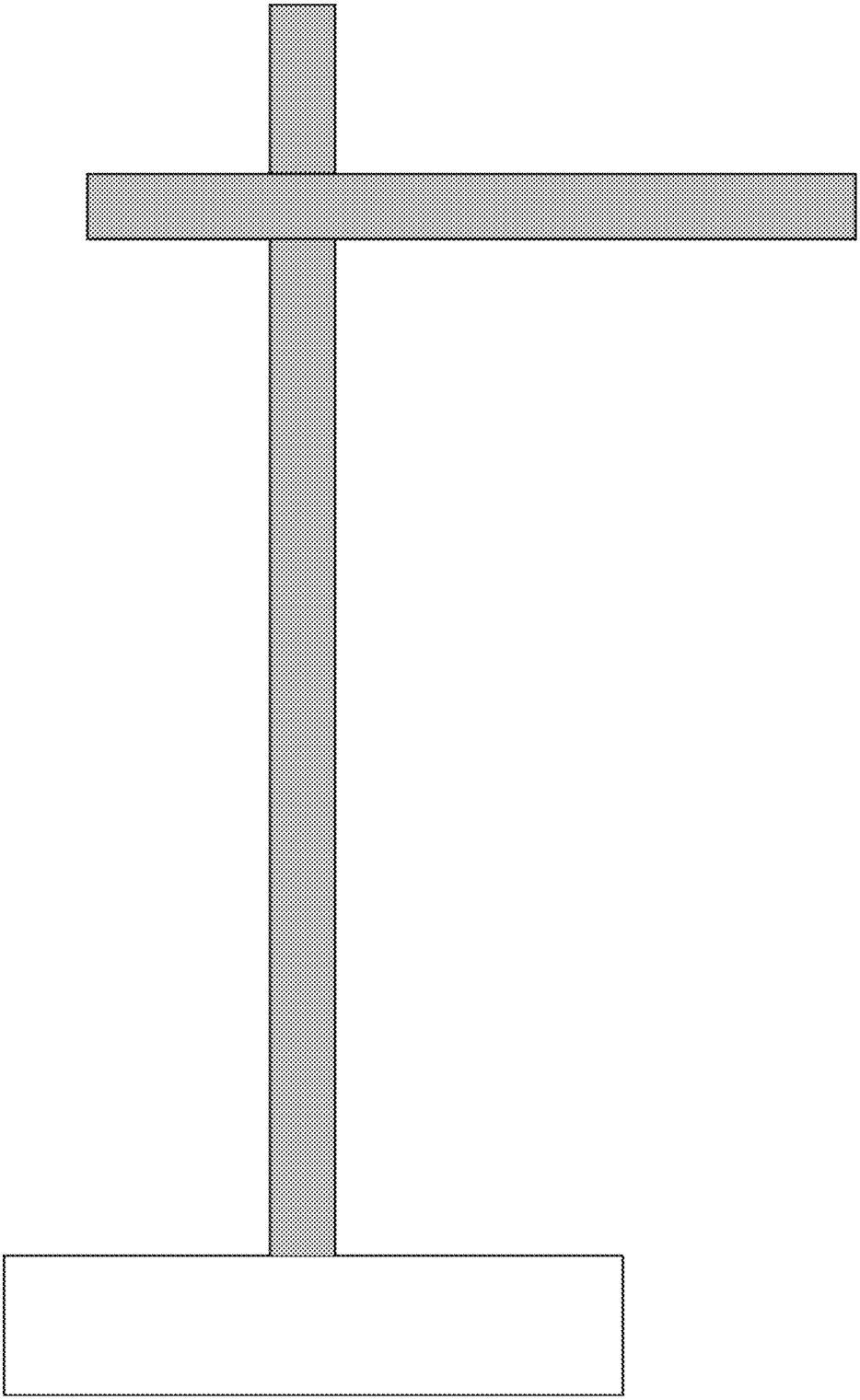
FIG. 24 illustrates a side view of a sign post installed within the support system of FIGS. 2A-2E and a cover positioned over the support system.
Figure 25:
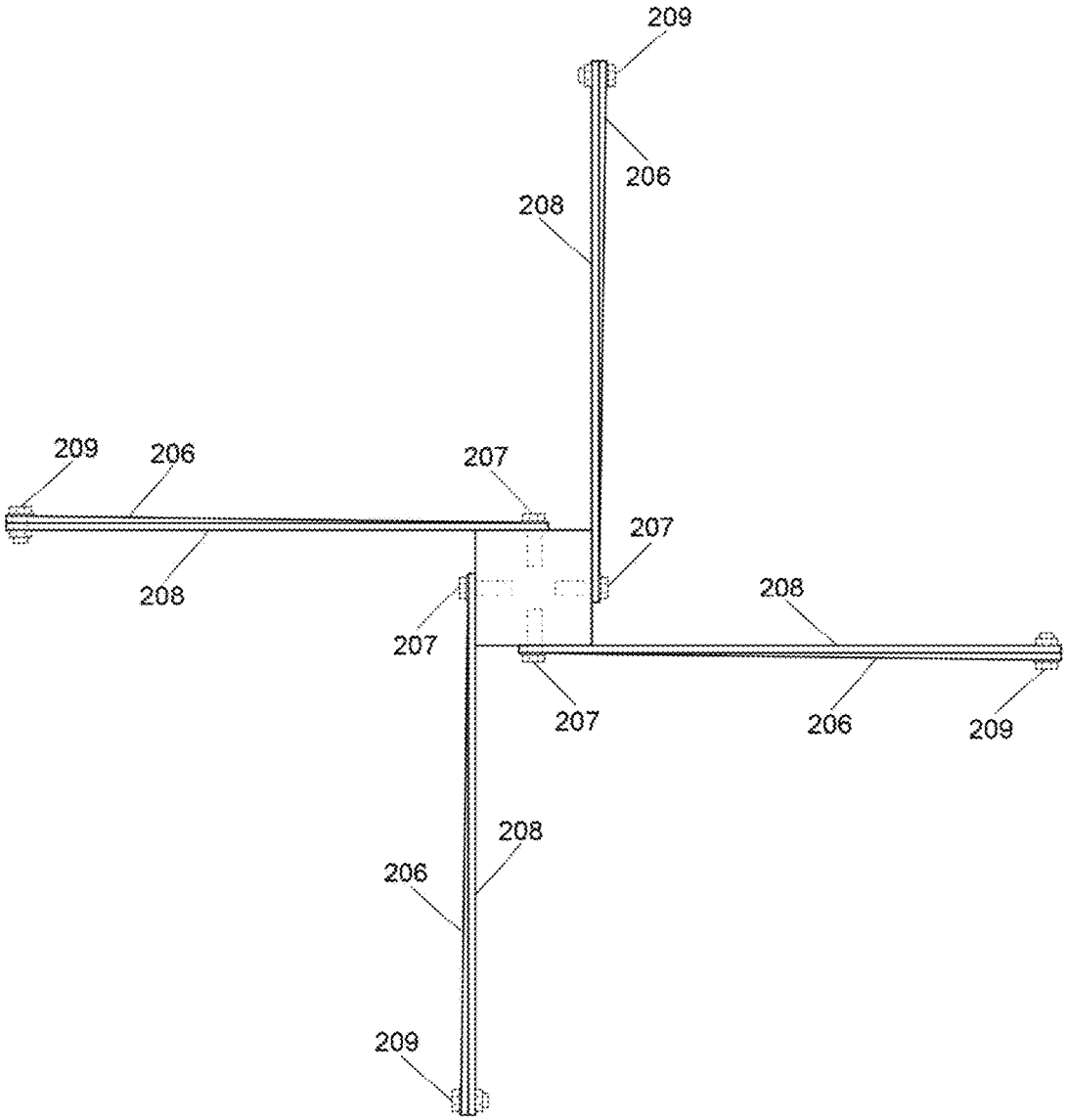
FIG. 25 illustrates a top view of the foldable support system of FIGS. 5 and 6 fastened to a sign post.
Figure 26:
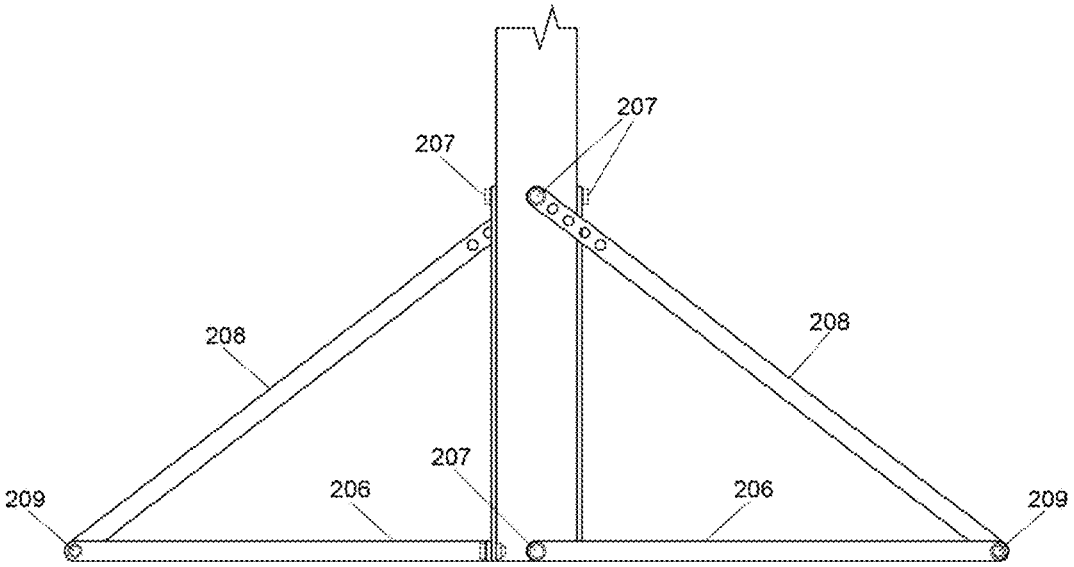
FIG. 26 illustrates a side view of the foldable support system of FIGS. 5 and 6 fastened to a sign post.
Figure 27:
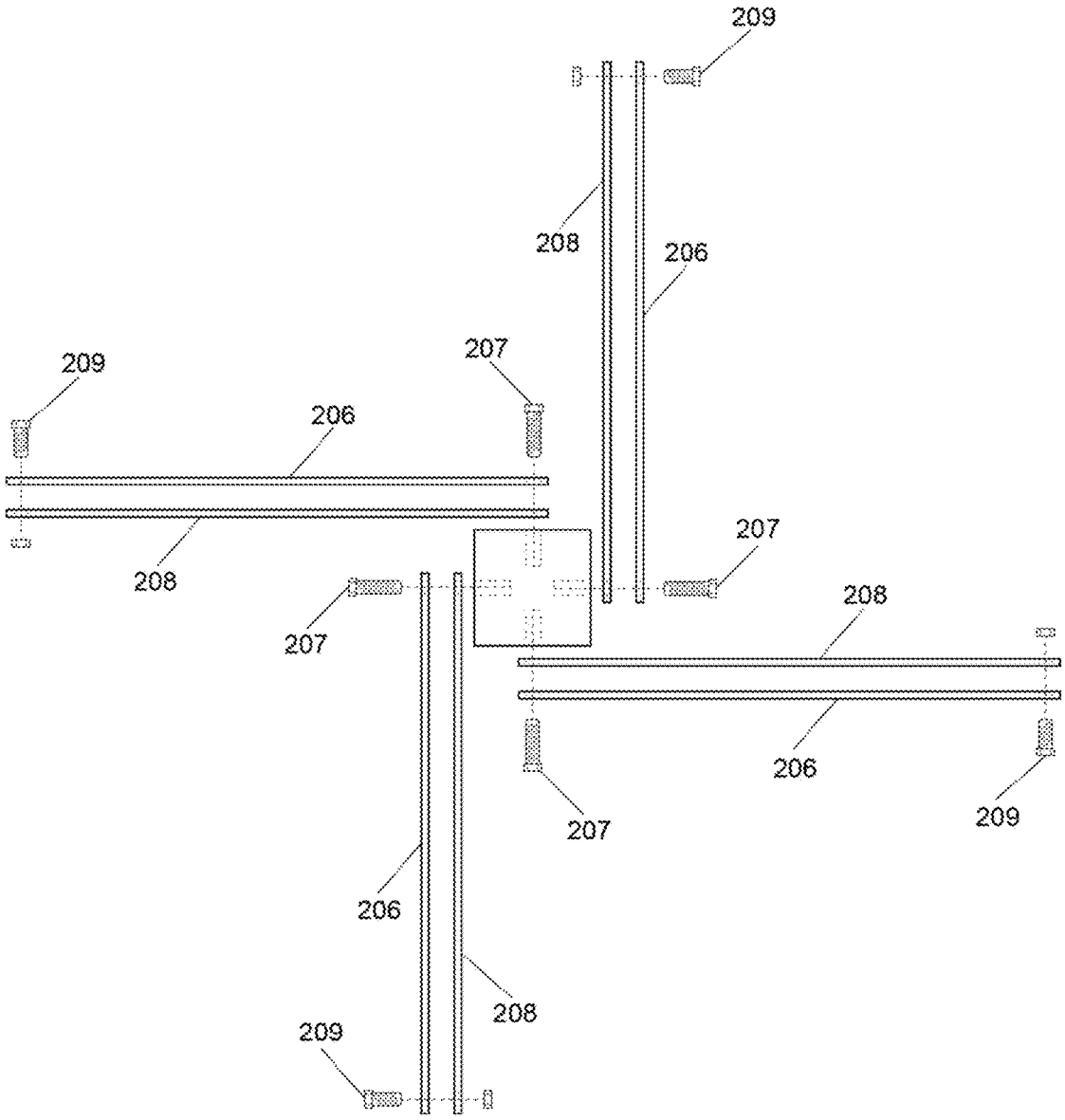
FIG. 27 illustrates a top exploded view of the foldable support system of FIGS. 5 and 6.
Figure 28:
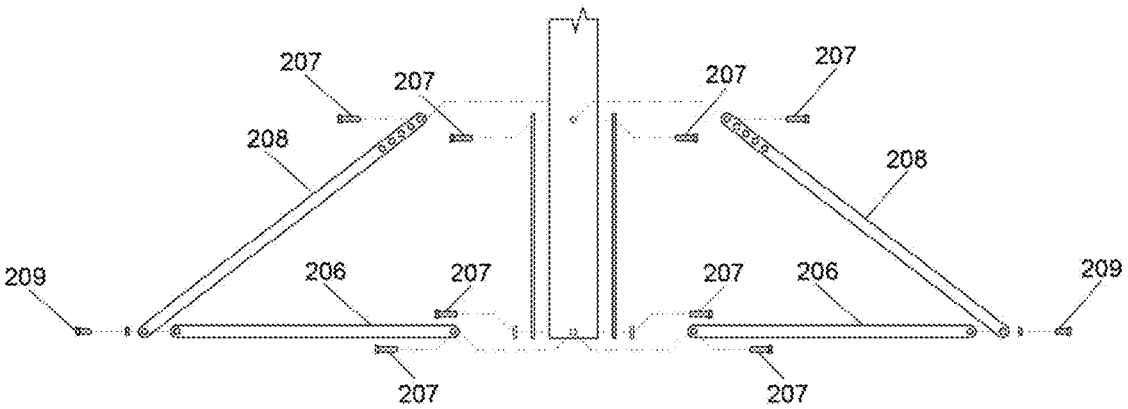
FIG. 28 illustrates a side exploded view of the foldable support system of FIGS. 5 and 6.

FIG. 18 illustrates that two support systems can be used to support two real estate sign posts to support a larger real estate sign, such as a commercial or specialty real estate sign.

FIGS. 19-24 illustrate additional views of the support system 100 of FIGS. 2A-2E, including the central column 102, the protective plates 103, the three arms 104, which can also be referred to as legs 104, the fasteners 106, which can be bolts 106, sandbags 107, which can be similar to the sandbags 112, and a cover 108, which can be similar to the cover 114. The protective plates 103 can prevent gouging of a sign post and distribute pressure evenly over the post for added stability. The sandbags 107 can be placed over the legs 104 to prevent the sign post from tipping over. The cover 108 can be positioned over the support system 100 to hide the support system 100 and its sandbags 107.

FIGS. 25-28 illustrate additional views of the support system 200 of FIGS. 5 and 6, including the bottom bars 206, the fasteners 207 and 209, which can be bolts 207 and 209, with the fastener 209 being shorter than the fastener 207, and the top bars 208.

Sign posts as described herein can be made from wood (e.g., in the form of 4×4 pieces of lumber), plastic, or metal. Any of the components of either the support system 100 or the support system 200 can be made from any suitable material, such as wood, plastic, or metal.

The sign post support systems described herein are advantageous at least in part because they allow a sign post to be positioned and installed without creating a hole in the ground, with no part of the sign post or the support system below ground level, and such that the bottom end of the sign post and the bottom end of the support system rest on the ground.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A sign system, comprising:

a support system resting on sloped ground, wherein the support system includes a hollow column having first, second, third, and fourth sidewalls, first and second fasteners extending through the first sidewall, third and fourth fasteners extending through the second sidewall, fifth and sixth fasteners extending through the third sidewall, and seventh and eighth fasteners extending through the fourth sidewall, the support system further including first, second, third, and fourth plates located inside the hollow column; and a plumb sign post having a bottom end portion supported by the support system;

wherein the first fastener extends a first distance through the first sidewall, the second fastener extends a second distance through the first sidewall, the second distance different than the first distance, the third fastener extends a third distance through the second sidewall, the fourth fastener extends a fourth distance through the second sidewall, the fourth distance different than the third distance, the fifth fastener extends a fifth distance through the third sidewall, the sixth fastener extends a sixth distance through the third sidewall, the sixth distance different than the fifth distance, the seventh fastener extends a seventh distance through the fourth sidewall, and the eighth fastener extends an eighth distance through the fourth sidewall the eighth distance different than the seventh distance;

wherein each of the fasteners bears directly against a respective one of the plates and each of the plates bear directly against the sign post;

wherein no part of the sign post is below ground level, no part of the support system is below ground level, a bottom end of the sign post rests on the ground, and a bottom end of the support system rests on the ground.

2. The sign system of claim 1, further comprising a sign supported by the sign post.

3. A support system for supporting a plumb sign post on sloped ground, comprising:

a hollow vertical column configured to accept a bottom end portion of the sign post, the hollow vertical column having a central open space; and a plurality of arms coupled to and extending outward from the hollow vertical column;

wherein the hollow vertical column has first, second, third, and fourth sidewalls, first and second fasteners extending through the first sidewall, third and fourth fasteners extending through the second sidewall, fifth and sixth fasteners extending through the third sidewall, and seventh and eighth fasteners extending through the fourth sidewall;

wherein when the support system is in use supporting the plumb sign post on sloped ground, the first fastener extends a first distance through the first sidewall, the second fastener extends a second distance through the first sidewall, the second distance different than the first distance, the third fastener extends a third distance through the second sidewall, the fourth fastener extends a fourth distance through the second sidewall, the fourth distance different than the third distance, the fifth fastener extends a fifth distance through the third sidewall, the sixth fastener extends a sixth distance through the third sidewall, the sixth distance different than the fifth distance, the seventh fastener extends a seventh distance through the fourth sidewall, and the eighth fastener extends an eighth distance through the fourth sidewall, the eighth distance different than the seventh distance.

4. The support system of claim 3, further comprising the plumb sign post having the bottom end portion positioned inside the hollow vertical column.

5. The support system of claim 4 wherein each of the fasteners bears directly against a respective plate bearing directly against the sign post.

6. The support system of claim 3, further comprising a respective weight positioned over each of the arms.

7. The support system of claim 6, further comprising a cover positioned over the support system.

8. The support system of claim 3 wherein, when the support system is in use supporting the plumb sign post on sloped ground, distal ends of the arms are the only portions of the support system in direct contact with the ground.

9. A method of installing a plumb sign post on a sloped ground surface, comprising:

positioning a support system on the sloped ground surface such that no part of the support system is below the ground surface, the support system including a hollow central column, wherein the hollow central column includes first, second, third, and fourth sidewalls, first and second fasteners extending through the first sidewall, third and fourth fasteners extending through the second sidewall, fifth and sixth fasteners extending through the third sidewall, and seventh and eighth fasteners extending through the fourth sidewall, the support system further including first, second, third, and fourth plates located inside the hollow column;

positioning a lower end portion the sign post within the hollow central column such that no part of the sign post is below the ground surface, such that a bottom end of the sign post rests on the ground surface, and such that the sign post is supported by the support system; and threading the first fastener a first distance through the first sidewall and the second fastener a second distance through the first sidewall, the second distance different than the first distance, threading the third fastener a third distance through the second sidewall and the fourth fastener a fourth distance through the second sidewall, the fourth distance different than the third distance, threading the fifth fastener a fifth distance through the third sidewall and the sixth fastener a sixth distance through the third sidewall, the sixth distance different than the fifth distance, and threading the seventh fastener a seventh distance through the fourth sidewall and the eighth fastener an eighth distance through the fourth sidewall, the eighth distance different than the seventh distance, such that each of the fasteners bears directly against a respective one of the plates and each of the plates bear directly against the sign post.

* * * * *